US006328161B1

(12) United States Patent
Kang

(10) Patent No.: US 6,328,161 B1
(45) Date of Patent: Dec. 11, 2001

(54) GOLF BAG

(76) Inventor: Pan-Gyu Kang, 916-62, Daechi-dong, Kangnam-ku, Seoul (KR)

( * ) Notice: Subject to any disclaimer, the term of this patent is extended or adjusted under 35 U.S.C. 154(b) by 0 days.

(21) Appl. No.: 09/452,292

(22) Filed: Nov. 30, 1999

Related U.S. Application Data

(63) Continuation-in-part of application No. 09/327,426, filed on Jun. 7, 1999.

(30) Foreign Application Priority Data

Sep. 15, 1999 (KR) ..... 99-39574
Sep. 20, 1999 (KR) ..... 99-20250

(51) Int. Cl.[7] ..... A63B 55/00
(52) U.S. Cl. ..... 206/315.3; 206/315.4; 206/315.6
(58) Field of Search ..... 206/315.2–315.6

(56) References Cited

U.S. PATENT DOCUMENTS 1,600,601 * 9/1926 Sampson ..... 206/315.2
1,637,538 * 8/1927 Sampson ..... 206/315.2
3,331,419 * 7/1967 Bencriscutto ..... 206/215.6
3,503,518 * 3/1970 Black ..... 206/315.6 X
4,055,207 * 10/1977 Goodwin ..... 206/315.6
4,194,547 * 3/1980 Sidor et al. ..... 206/315.6
4,629,202 * 12/1986 Nelson et al. ..... 206/215.2 X
5,135,107 * 8/1992 Ingraham ..... 206/315.6
5,228,566 * 7/1993 Shenoha ..... 206/315.6
5,772,024 * 6/1998 Lueders ..... 206/315.6
5,775,513 * 7/1998 Anthony ..... 206/315.6 X
5,816,397 * 10/1998 Pratt ..... 206/315.6
5,911,322 * 6/1999 Lombardo et al. ..... 206/315.6 X

* cited by examiner

*Primary Examiner*—Sue A. Weaver
(74) *Attorney, Agent, or Firm*—Blakely Sokoloff Taylor & Zafman

(57) ABSTRACT

The present invention relates to a golf bag, more particularly to the golf bag equipped with a frame, the frame whereto a tube set, whereby a plurality of golf clubs are separately divided, is easily assembled so that the golf clubs are not entangled one another.

The present invention comprises an upper body formed in a cylindrical structure, a frame disposed in the top portion of the upper body for maintaining the configuration of the golf bag, a lower body installed in the bottom portion of the upper body used as a bottom part enclosing the bottom portion of the upper body for supporting a grip portion of the golf club, and a separation means coupled with the frame and supporting the side face of the head of the golf club wherein the grip portion is supported at a lower body for separating the golf clubs in order to prevent clashes between the head of the golf club and frame and the easy discernment of the head of each golf club that is inserted inside the upper body.

18 Claims, 26 Drawing Sheets

GOLF BAG

CROSS-REFERENCES TO RELATED APPLICATIONS

The present application is a continuation in part of the application Ser. No. 09/327,426 field Jun. 7, 1999, entitled "GOLF BAG", by the Applicant Pan-gyu Kang, currently pending. This application is incorporated herein by this reference.

This application is based on Nos. 99-39574 and 99-20250 filed in the Korean Industrial Property Office on Sep. 15, 1999 and Sep. 20, 1999 the content of which is incorporated herein by reference.

BACKGROUND OF THE INVENTION (a) Field of the Invention

The present invention relates to a golf bag, more particularly to the golf bag equipped with a frame, the frame wherewith a tube set whereby a plurality of golf clubs are separately divided, is easily assembled so that the golf clubs respectively inserted into the golf bag are not entangled with one another.

(b) Description of the Related Art

Golf bags have at times walls for achieving separate collection of the golf clubs.

A golf bag with inner walls thereinside, however, still has a problem in that even though the golf clubs are separately secured inside the golf bag, the golf clubs still clash with one another in the upper portion of the bag.

To solve this problem, either head covers may be put on the head portions of the golf clubs or multiple tubes may be installed for separately securing the inserted portions of the golf clubs.

These tubes are coupled inside both the upper and lower portions of the golf clubs while the same are coupled at random locations inside the frame.

The golf clubs inserted into the respective tube are divided but the upper portion and heads of the golf clubs can still clash with one another and/or are exposed outside the golf bag.

Conventional golf bags, moreover, also have the following defects:

(a) assembly of the golf bag becomes complicated because tubes for dividing the golf clubs inserted inside the frame are coupled to the golf bag on an one by one basis, with the result that the golf bag becomes enlarged and an extra reinforcing support member is required to prop up the tubes;

(b) head covers of the golf clubs should be provided for preventing clashes among the golf clubs, and since the golf clubs are designed to move freely when the golf bag is moved around, clangorous noises often result due to the clashes of the golf clubs with each other;

(c) since the tubes are disorderly coupled to the golf bag even though identification numbers are inscribed on the heads of the golf clubs, it is difficult and takes much time to identify the designated golf club out of the plurality of golf clubs inserted in the golf bag and to recognize if a specific golf club is lost or missing.

(d) when the golf clubs are inserted into the tube of the golf bag, damage may be done on the protruded portion of the golf clubs that is extended out of the golf bag while the golf bag is being carried around;

(e) the inside volume of the golf bag is not available for other purposes because the tubes are coupled down to the center portion of the golf bag.

SUMMARY OF THE INVENTION

The present invention made to solve the above problems provides a golf bag coupled with an integrated tube set wherein a number of golf clubs are divided up and inserted, the golf bag having a simplified assembly feature.

The present invention also provides a golf bag wherein even though there is no extra head cover required for the golf clubs, clashes among the inserted golf clubs inside the golf bag are prevented and therefore clangorous noises do not result when the golf bag is moved in any direction.

The present invention also provides a golf bag wherein the golf clubs inserted into the golf bag can be recognized in the shortest time possible, and an identification of a lost or missing golf club can be easily and effectively made.

The present invention also provides a golf bag wherein while the golf bag is either in storage or moved around, golf club damaged is preventing by not allowing the golf clubs to be extended out of the golf bag.

The present invention also provides a golf bag wherein pockets are designed to be placed inside the golf bag such that the volume of the golf bag can become compact and wherein the inside of the golf bag may be used for such pockets.

The present invention also provides a golf bag wherein manufacturing of the golf bag is simplified and wherein pockets are designed to be placed inside the golf bag.

The present invention also provides a golf bag wherein a soft tube set, wherein a plurality of golf clubs are respectively inserted, is easily coupled as a unit having a simplified assembly feature and which renders the golf bag lightweight.

The present invention to accomplish the above purpose is composed of the following:

an upper body formed in a cylindrical structure;

a frame disposed in the top portion of the upper body for maintaining the configuration of the golf bag;

a lower body installed in the bottom portion of the upper body used as a bottom part enclosing the bottom portion of the upper body for supporting a grip portion of the golf club; and a separation means coupled with the frame and supporting the side face of the head of the golf club wherein the grip portion is supported at a lower body for separating the golf clubs in order to prevent clashes between the head of the golf clubs and frame and the easy discernment of the head of each golf club that is inserted inside the upper body.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE PREFERRED EMBODIMENTS

Figure 1:
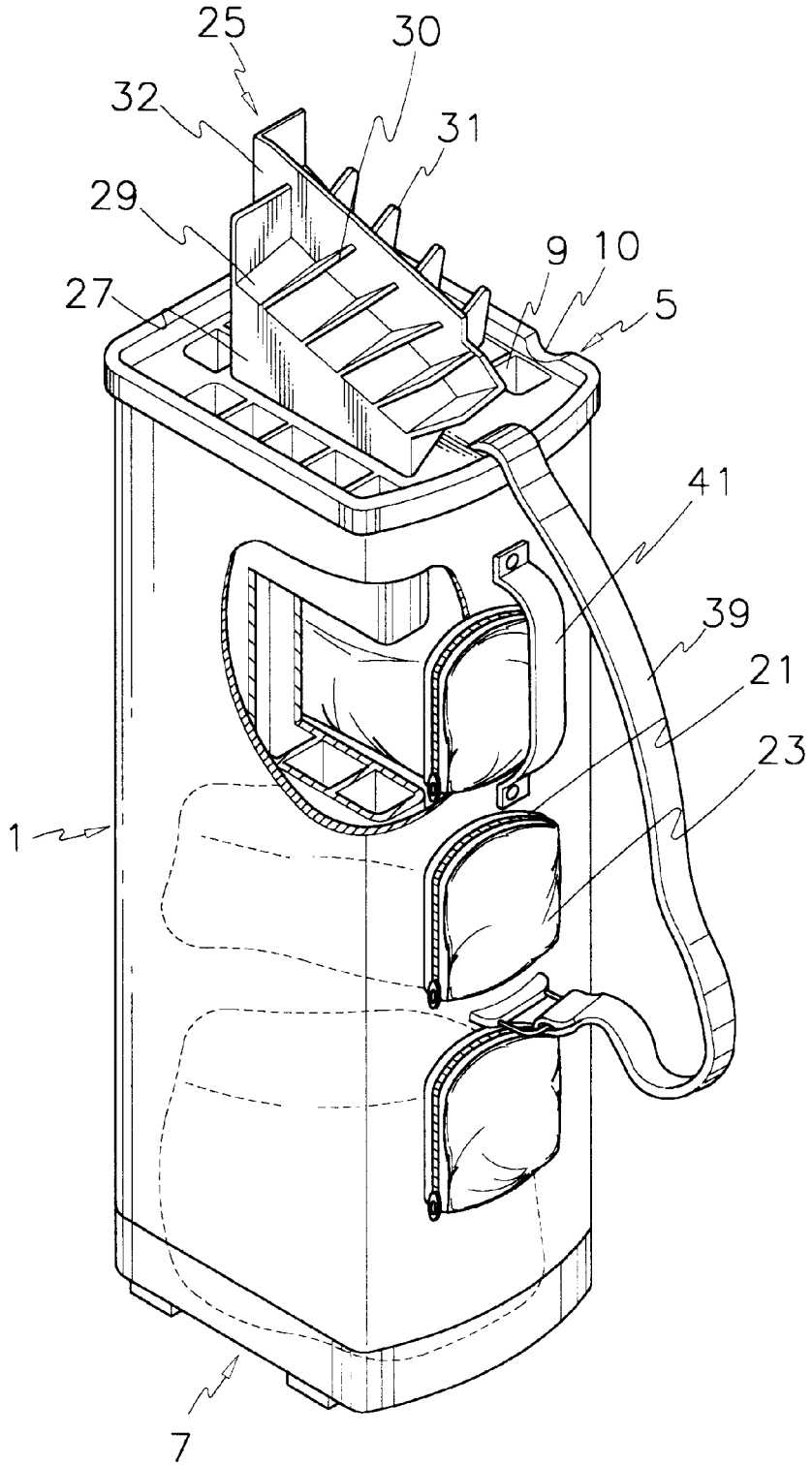
FIG. 1 is a partial cut away perspective view according to the first embodiment of the present invention.
Figure 2:
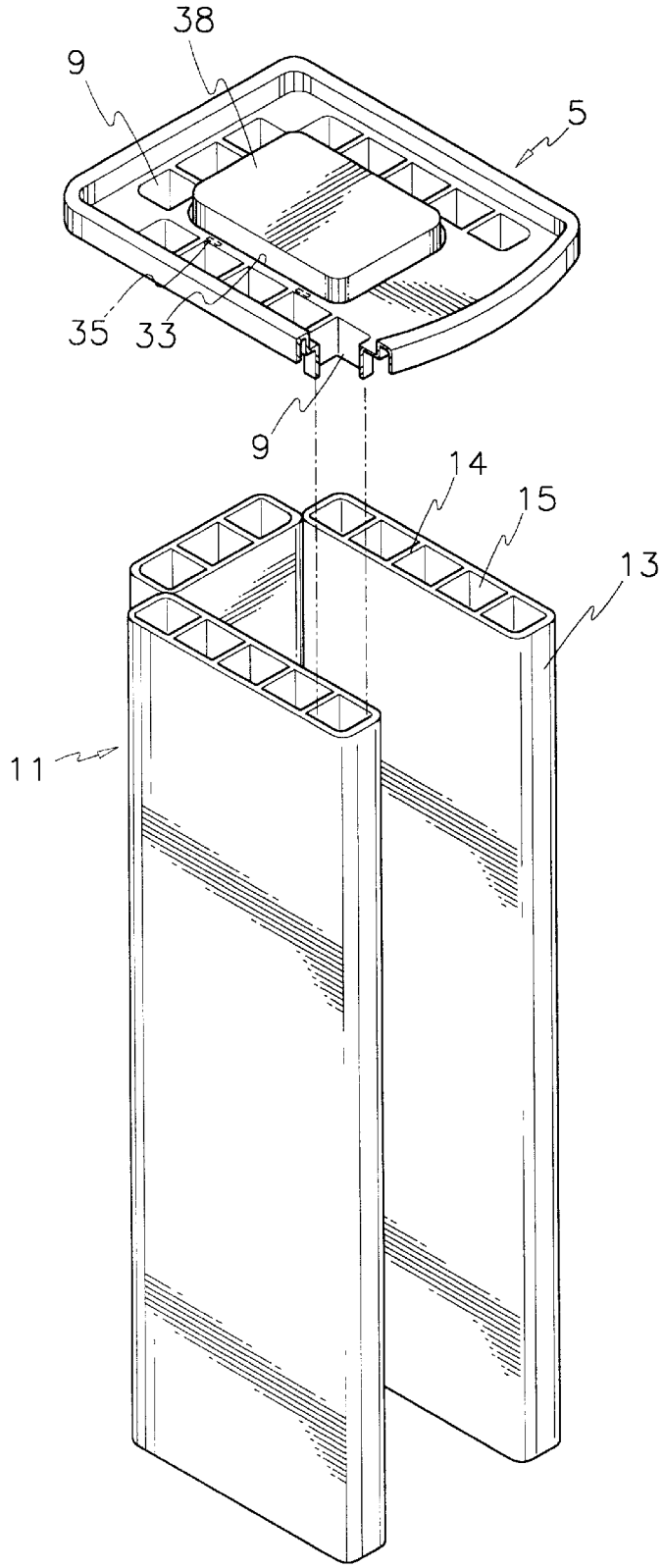
FIG. 2 is an exploded perspective view of main parts of the golf bag according to the first embodiment of the present invention.
Figure 3:
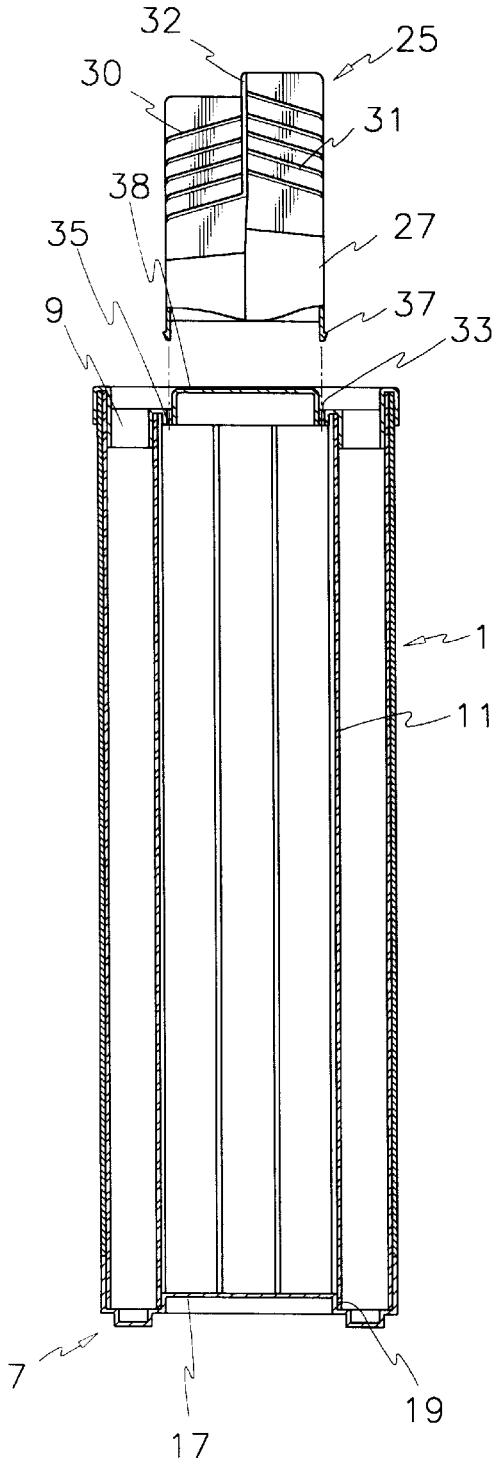
FIG. 3 is a cross sectional view of a golf bag according to the first embodiment of the present invention.

In the following detailed description, only the preferred embodiment of the invention has been shown and described, simply by way of illustration of the best mode contemplated by the inventor of carrying out the invention. As will be realized, the invention is capable of modification in various respects, all without departing from the invention. Accordingly, the drawings and description are to be regarded as illustrative in nature, and not restrictive.

Detailed description of the preferred embodiment of the present invention with reference to the appended drawings is made as follows.

The golf bag according to the present invention with reference to FIGS. 1 through 5 is composed of the following:

an upper body 1 formed in a cylindrical structure;

a frame 5 disposed in the top portion of the upper body 1 for maintaining the configuration of the golf bag; and a lower body 7 installed in the bottom portion of the upper body 1 acting as a bottom part enclosing the bottom portion of the upper body 1 and contacted with a grip portion 120 of a golf club 100 that is inserted inside an upper body for support the grip portion 120.

The upper body 1 is formed by sewing or riveting as a unit with the frame 5 or the lower body 7.

The frame 5 is provided with the protrusively disposed insertion tube 9 spaced apart from the center portion of the frame for dividing up the golf clubs 100 inserted into the golf bag.

The frame 5 is also provided one or more than fixation homes 10 or protruded fixation members that are formed along the edge of the frame 5 in an insertion homed pattern or protruded pattern, the fixation homes 10 or protruded fixation members whereinto the head portions 110 of the golf clubs 100 are settled through insertion when the head portions 110 of the golf clubs are required to be disposed outside the frame 5.

The above fixation homes 10 or the protruded fixation members are preferably formed at the frame area located outside the insertion tube 9 wherein the most frequently used golf clubs, especially the putter 100, are secured.

The insertion tubes 9 are coupled as a unit with a tube set 11 for separating and inserting the golf clubs that are placed through the insertion tubes 9 inside the upper body 1.

The insertion tubes 9 are disposed such that the same are formed at the edge of the frame spaced at an arbitrary interval so that the head 110 of the inserted golf club 100 may not be extended out the frame but rather remain within the frame 5. The center portion of the frame 5 is preferably formed in a sealed pattern.

The insertion tubes 9 can be made in any pattern, including a rectangle and a circle, as far as the same can support the golf clubs.

The tube set 11 comprises a body 13 making one end thereof opened and having thereinside an arbitrary volume of a predetermined shape (for example, an open box or "" shape) wherein the golf clubs are supported, the body also provided with insertion holes 15 for the insertion of the golf clubs 100 that are separately arranged at an arbitrary interval by a partition member 14 and coupled with the insertion tube 9 by insertion.

The lower portion of the body 13 is connected as a unit with a coupling home 19 formed by a protruded portion 17 that is made in the center portion of the body 7.

The body 13 is preferably made in a three dimensional rectangular pattern with a minimal amount of predetermined structural strength.

The body 13 can also be made of a plurality of member units that are formed corresponding to the direction of installation of the insertion holes 15 and respectively formed at an arbitrary interval.

The upper body 1 is provided with more than one pockets 23 in which items are supported and that are opened or closed with zipper 21, with a result that the inner space of a tube set 11 is effectively utilized.

The pockets 23 are preferably installed from the front side of the upper body 1 toward the inner space of the tube set so that the same may secure items more efficiently.

A separation means 25 is coupled with the frame 5 and supports the side face of the head 110 of the golf club 100 wherein the grip portion 120 of the golf club 100 is supported at a lower body 7 for separating the golf clubs 100 in order to prevent clashes between the head of the golf club 100 and the frame 5 and for the easy discernment of the head 110 of each golf club 100 that is inserted inside the upper body 1.

The separation means 25 is formed for either being in contact with or separated from the lower face of the head 110 of the golf club 100 when the same supports the side face of the head 110 of the golf club 100.

The above separation means 25 comprises a base 27 disposed in the center portion of the frame 5 and head partition members 30 and 31 installed on one face of the base 27 for separating and supporting while guiding the heads 110 of each golf club 100 and fixing them in place.

An upper face of the base 27 is formed with a slanted portion 29 so that the golf clubs 100 divided by the head partition member 30 and 31 may be easily discerned and stably supported.

The head partition members 30 and 31 are preferably designed such that the same of each row are formed with different angles to improve the discernment of the heads of the golf clubs from the outside.

The above base 27 can also be provided with a partition board 32 for separating each head partition member 30 and 31.

Figure 6:
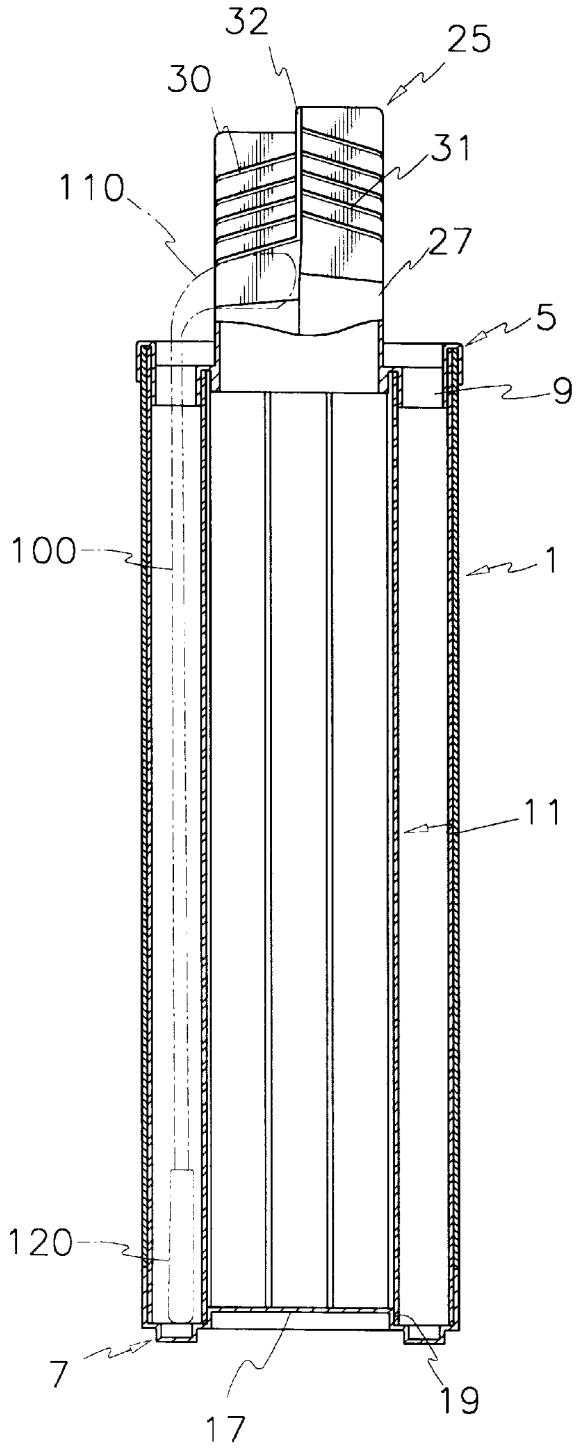
FIG. 6 is a cross sectional view of the golf bag according to the second embodiment of the present invention.

The base 27 is either made as a unit with a frame 5, or made detachably by means of an extra coupling means to thus facilitate the coupling of the upper body 1 to the frame 5 as shown in FIG. 6.

The above mentioned coupling means comprises a coupling home 33 of an arbitrary size formed in the center portion of the frame 5 and a hook protrusion 37 that is protrusively formed on one side face of the base 27 and is intended to be connected to a hook hole 35 formed in the coupling home 33.

The heights of the head partition member 30 and 31 of each row are either made the same or differently according to the length of the golf clubs to make an easy discernment of each identification number inscribed on the heads 110 of the golf clubs 100.

The above head partition members 30 and 31 are formed at an arbitrary angle with respect to the slanted portion 29 so that the heads 110 of the golf clubs 100 are precisely guided and supported and convincingly settled.

The head partition members 30 and 31 are preferably made of a soft material so that it causes no damage to the heads 110 of the golf clubs 100 and minimizes contact noise.

In the center portion of the above frame 5 is disposed a protrusion portion 38 protrusively formed and having an arbitrary height for facilitating insertion of a hook protrusion 37 of the coupling means into a hook hole 35 and for propping up the separation means 25.

Element 39 of FIG. 1 is a golf bag string, and a part 41 is a portable strap.

The golf bag of the present invention, while the upper body 1 is coupled with both the frame 5 and the lower body 7, is made such that the upper portion of the body 13 of the tube set 11 is coupled to the insertion tubes 9 of the frame 5 by insertion to thus form a unit, and the lower portion of the body 13 is coupled to the coupling home 19 formed in the lower body 7 by insertion to thus form a unit.

The separation means 25, while the base 27 of the separation means 25 is inserted into the coupling home 33 formed in the center portion of the frame 5, is coupled to the frame 5 by hooking the hook protrusion 37 of the base 27 into the hook hole 35.

In the state of the above mentioned structure, when the golf clubs 100 are respectively inserted into separate insertion tubes, the golf clubs 100 are inserted into the insertion holes 15 of the tube set 11 to thus be supported separately.

The heads 110 of the golf clubs 100 exposed outside the insertion tubes 9 and supported while guided by means of the head partition members 30 and 31, the partition board 32, and the slanted portion 29 of the separation means 25 have the following advantages:

a) the golf club heads do not clash with each other;

b) unstable movement of the heads of the golf clubs is prevented even though the golf bag is moved in any direction; and c) the identification number of each head of the golf clubs supported in each head partition member 30 and 31 may easily be discerned from the outside.

The pockets 23 disposed in the front side of the upper body 1 are opened with zipper 21 to support and store items, the same 23 enabled to accommodate large size items because the inside volume of the tube set 11 is fully used for storage space.

Figure 4:
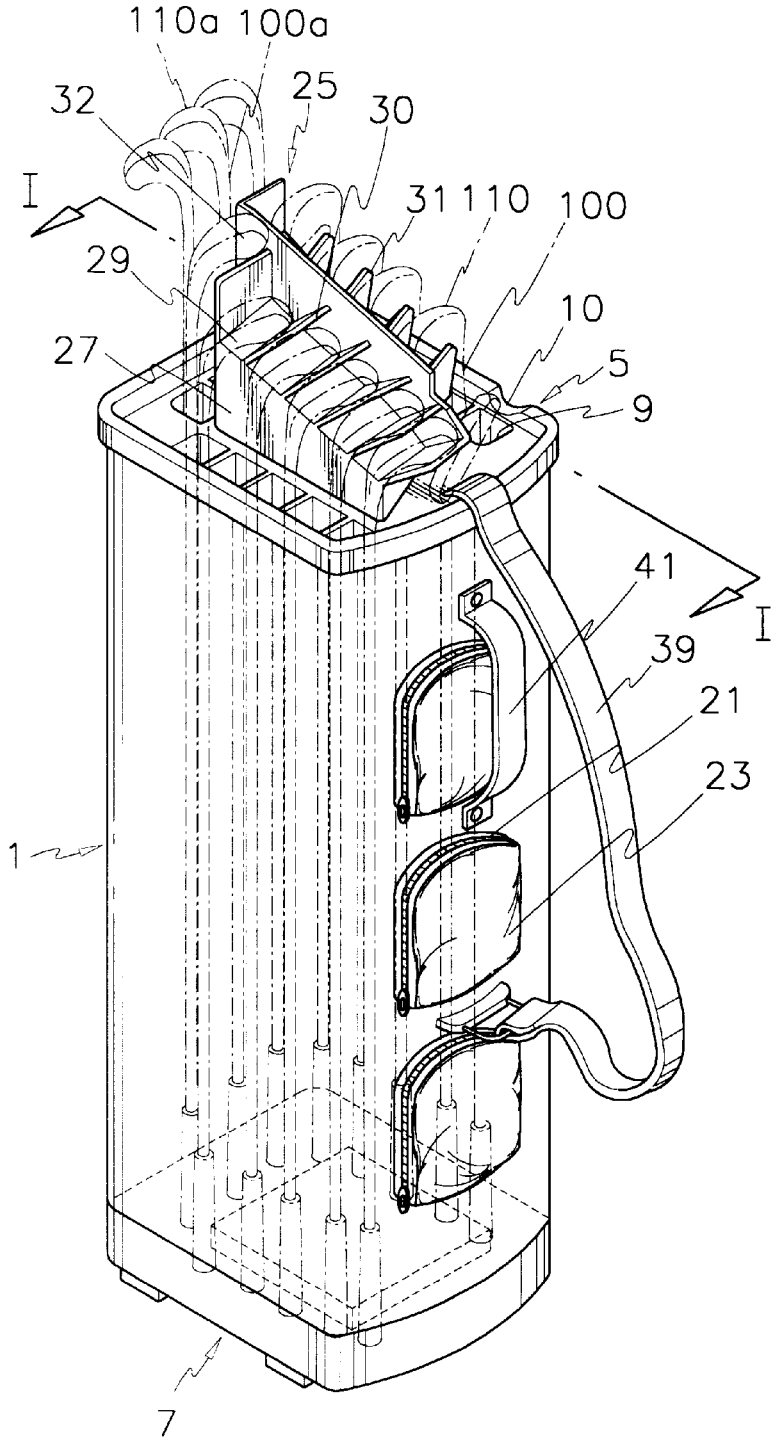
FIG. 4 is a perspective view of a golf bag according to the first embodiment of the present invention.

The head 110 of the golf club 100 used for putting that is inserted in the insertion tube 9 indicated in FIG. 4 is positioned at the forefront lower portion of the base 27 and is supported in an arbitrary sized space that is formed between the front bottom portion of the upper face of the base 27 and the top face of the frame 5 as shown in FIG. 4.

When heads 110*a* of wood type golf clubs 110*a* are inserted with a higher position than the back portion of the head partition members 30 and 31 at the insertion tubes 9 situated at the back of the base 27, extra head partition members for separating the heads of wood type golf clubs can be disposed between heads 110*a* of wood type golf clubs 100*a*.

Figure 5:
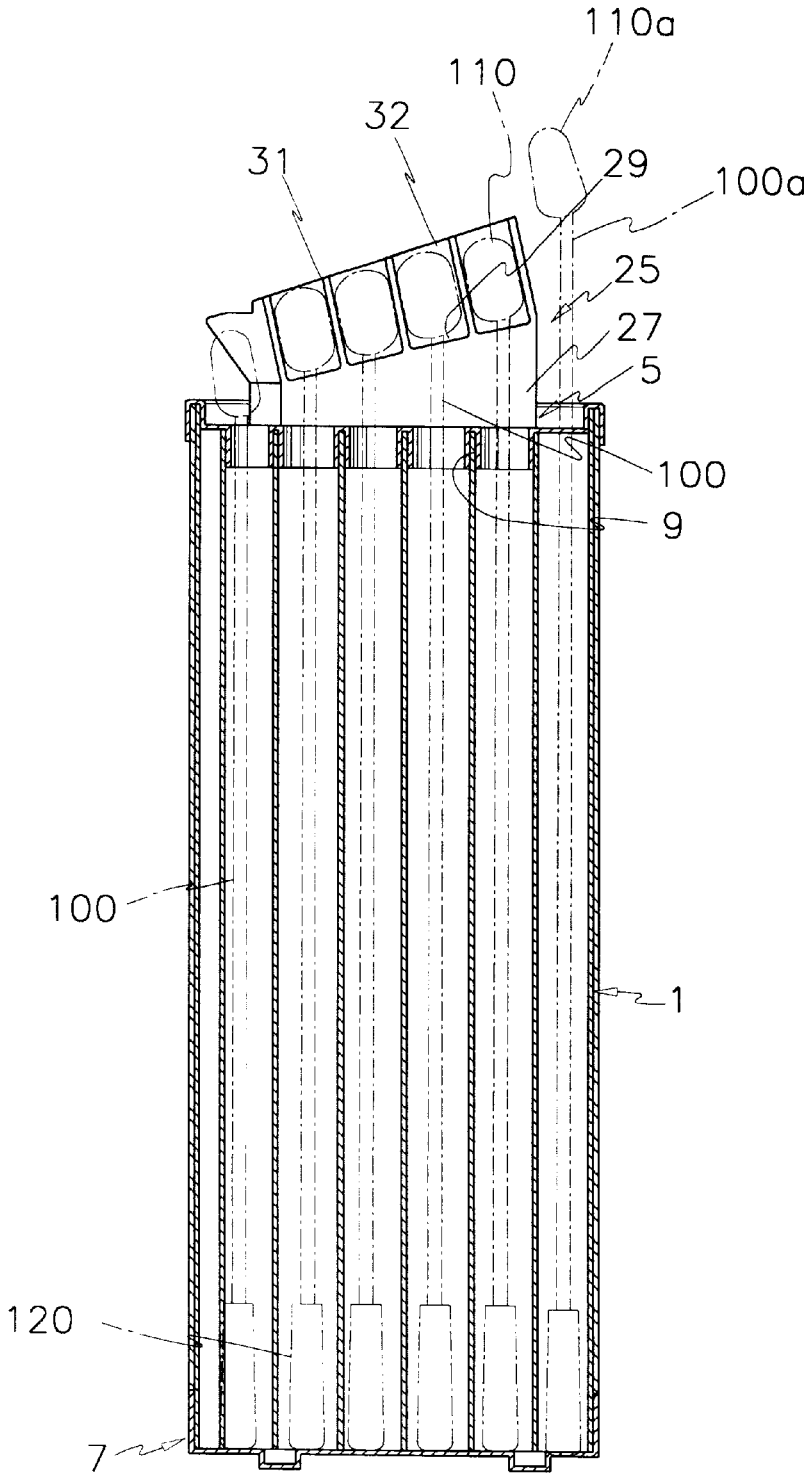
FIG. 5 is a cross sectional view at I—I line of FIG. 4.

The grip of each golf club 100 is also supported by being completely in contact with the lower body 7 as shown in FIG. 5 while the head 110 of the golf clubs 100 are separated by the head partition members 30 and 31 and the partition board 32 and are also in contact with the side face of the head partition members 30 and 31.

The heads 110 of the golf clubs 100 have an arbitrary interval with the upper face of the base 27 so that the heads 110 of the golf club 100 contact the side faces of the head partition members 30 and 31 and the golf clubs 100 can be supported by the lower body 7.

Since the grip of a golf club 100 is supported and is in contact with the lower body 7, the length of the upper body 1 can be formed with the same length of the upper body of a conventional golf bag.

FIGS. 7 through 12 show the golf bag according to a third embodiment of the present invention, the third embodiment has the same technical features as the first embodiment of the present invention other than the hereinafter mentioned description.

Figure 7:
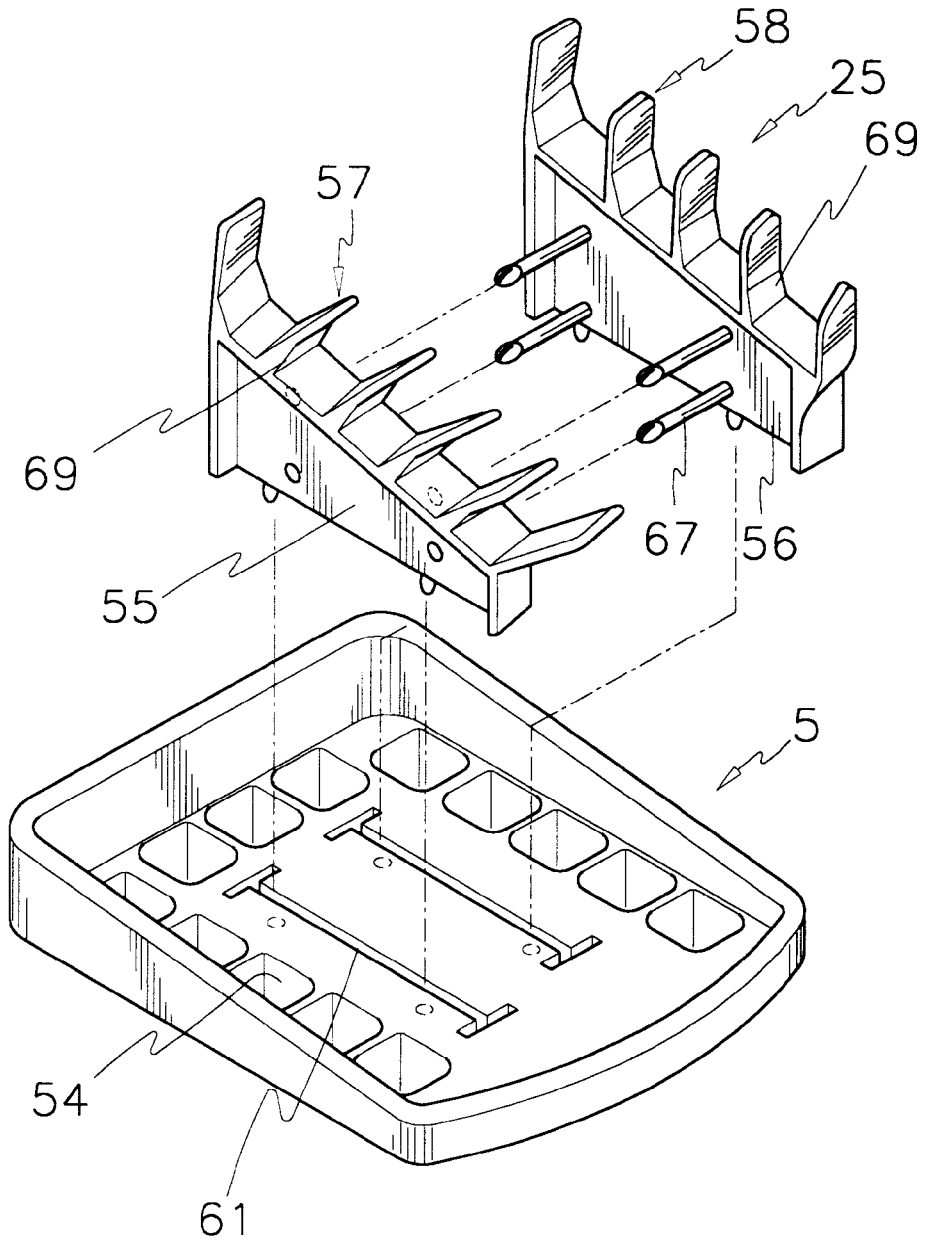
FIG. 7 is a partial exploded perspective view of the golf bag according to the third embodiment of the present invention.

FIG. 7 shows that separation means 25 comprises first and second base members 55 and 56 disposed at the upper face of the frame 5 within the area where the golf clubs 100 are inserted and spaced at arbitrary intervals and a plurality of head partition members 57 and 58 are installed on the upper face of the first and second base members 55 and 56 with a predetermined or arbitrary interval, and thereby supporting and separating the side face of the heads 110 of the golf clubs 100 inserted within the upper body 1 so that the heads 110 of the golf clubs 100 do not clash with each other.

The above head partition members 57 and 58 are preferably either made of a soft material or made of hard material that is then covered with cloth so that, they cause no damage to the heads 110 of the golf clubs 100 and minimizes contact noise.

The head partition members 57 and 58 can also be formed at a right or some predetermined angle with the upper face of first and second base members 55 and 56, and formed at a right or some other predetermined angle with respect to the length of the first and second base members 55 and 56.

Figure 8:
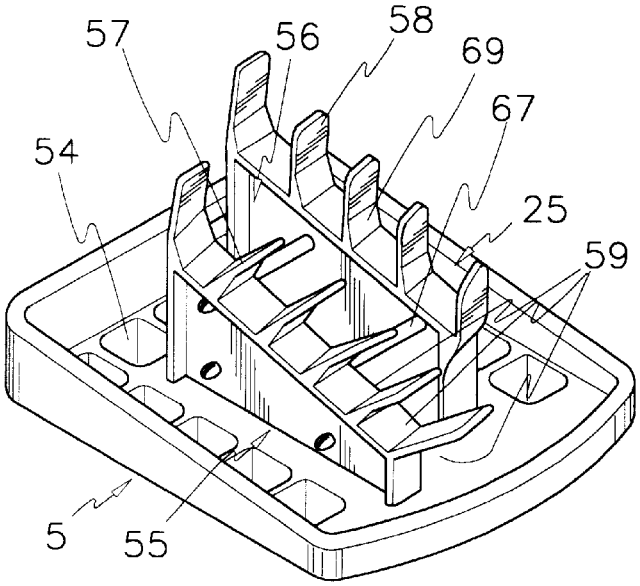
FIG. 8 is a partial perspective view illustrating the assembly of the golf bag according to the third embodiment of the present invention.
Figure 9:
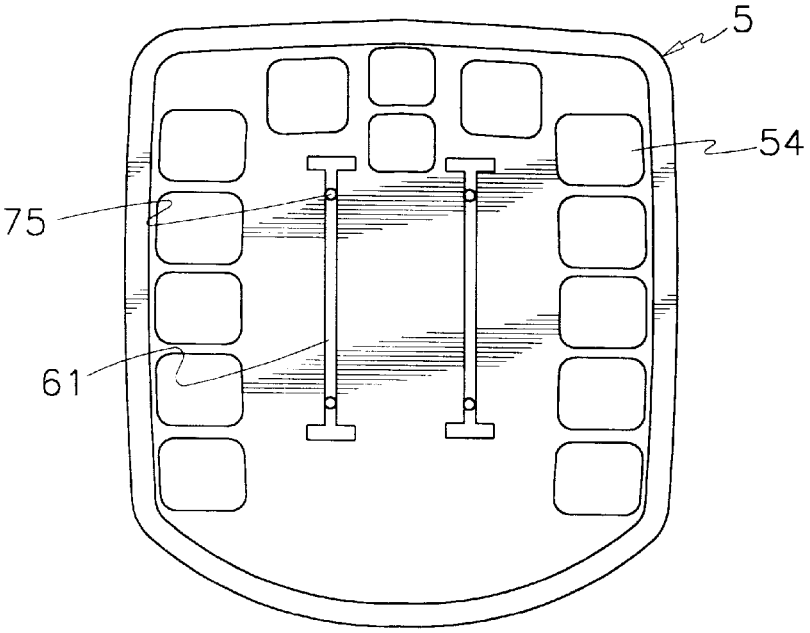
FIG. 9 is a plane view of the frame according to the third embodiment of the present invention.
Figure 10:
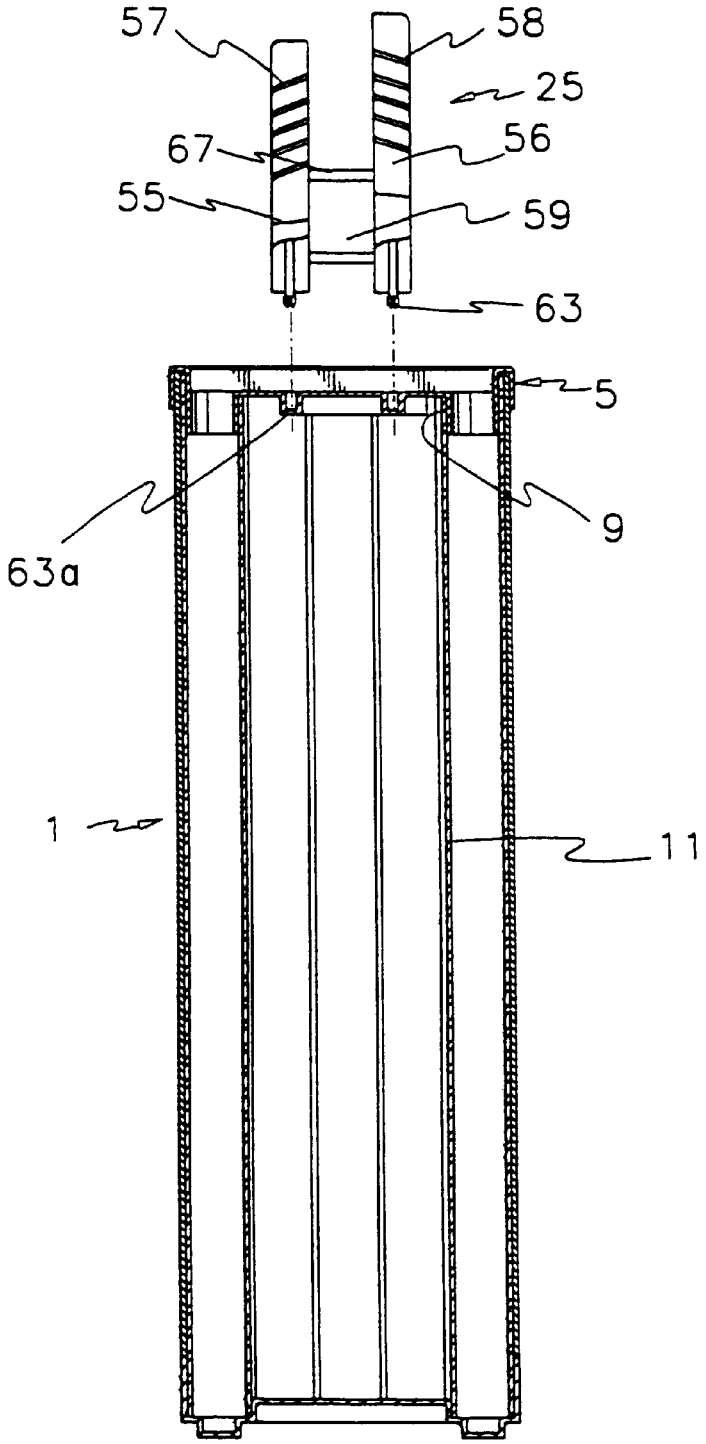
FIG. 10 is a cross sectional view illustrating the assembly of the golf bag according to the third embodiment of the present invention.
Figure 11:
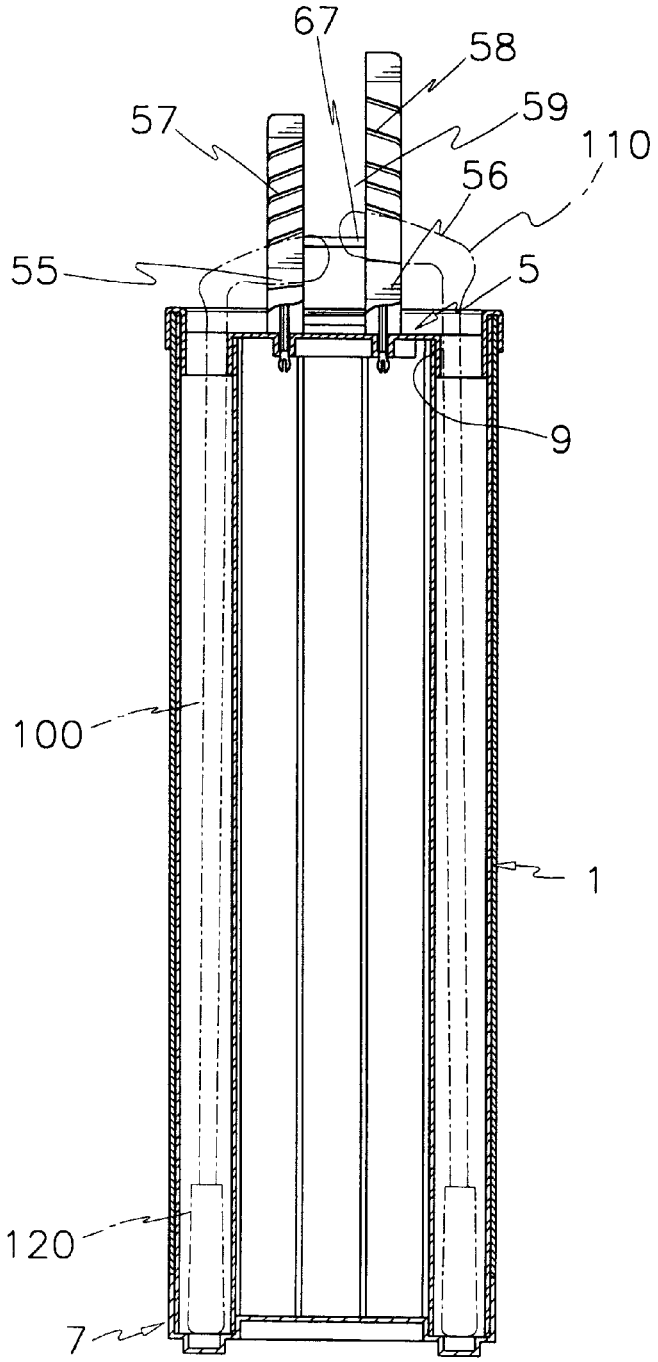
FIG. 11 is a cross sectional view illustrating the usage of the golf bag according to the third embodiment of the present invention.
Figure 12:
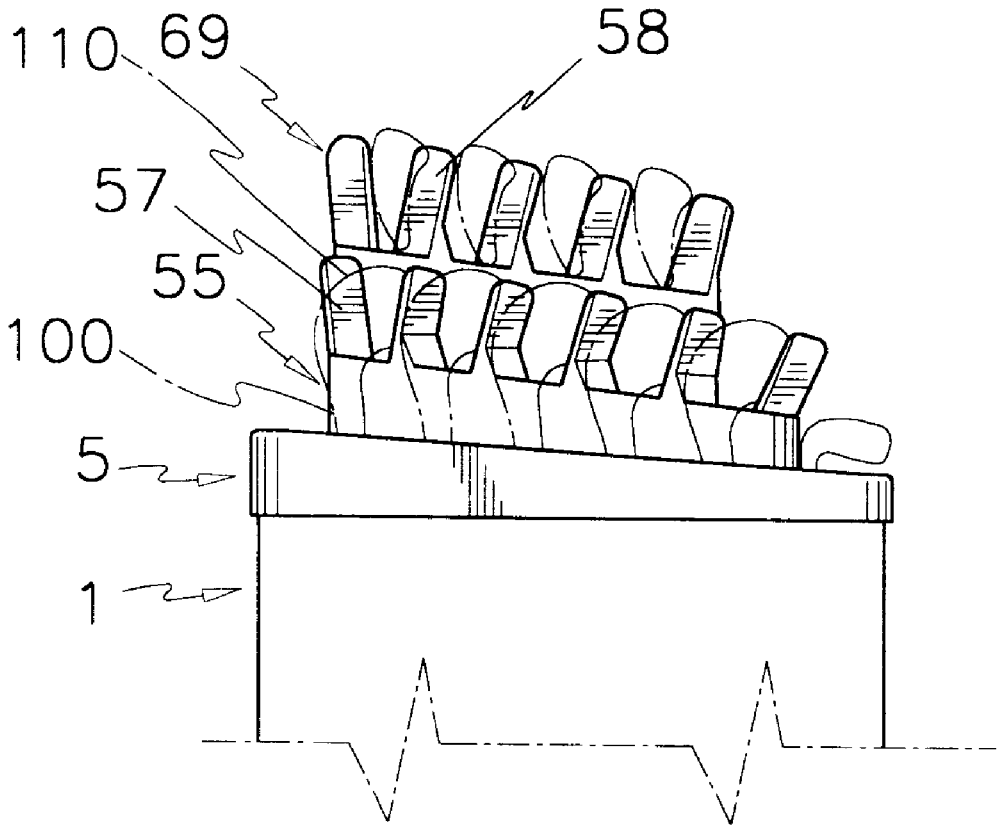
FIG. 12 is a partial side view illustrating the usage of the golf bag according to the third embodiment of the present invention.

FIG. 8 indicates that between the first and second base members 55 and 56 are formed space portion 59 so that a head 110 that is supported at a row of the head partition member 57 can be inserted next to a bottom portion of the head 110 of a golf club 100 that is supported in the row of the head partition member 58 next to the head partition member 57 as shown in FIGS. 10 and 11.

The space between the first and second base members 55 and 56 can also be made at an arbitrary interval so that the heads 110 of the golf clubs 100 supported in each row of the head partition members 57 and 58 do not clash with each other. The first and second base members 55 and 56 are preferably formed with different heights.

In the frame 5 is formed a hook hole 63*a* to hook the hook protrusion 63 of the first and second base members 55 and 56, wherein the coupling home 61 is made for coupling the first and second base members 55 and 56, respectively, so that the first and second base members 55 and 56 and the frame 5 are fixedly coupled in the coupling home 61.

The coupling home 61 is made in an I-type shape being the same shape as the bottom portion of the frame 5, however, any shape can be preferred as far as it can be connected with the frame 5. The frame 5 and the first and second base members 55 and 56 can also be coupled by bolting.

Between the first and second base members 55 and 56 is disposed more than one reinforced support member 67 to strengthen the rigidity of the base members 55 and 56.

On one side of the head partition members 57 and 58 is disposed a reinforcement portion 69, whereon the same is formed with an arbitrary size so that the same stably supports the head 110 of the golf club 100 inserted into the head partition member and strengths the rigidity of the head partition member.

The golf bag of the present invention, while the upper body 1 is coupled with the frame 5 and the lower body 7, is made such that the upper body of the tube set 11 is coupled to the insertion tube 9 of the frame 5 by insertion to thus form a unit, and the lower portion of the tube set 11 is formed as a unit with the lower body 7.

A hook protrusion 63 of the first and second base members 55 and 56 of the separation means 25 is respectively inserted into the coupling home 61 formed in the center portion of the upper face of the frame 5.

With the above mentioned structure, when golf clubs 100 are respectively inserted into insertion tubes 9, the golf clubs 100 are thus inserted into the tube set 11 to thus be supported separately.

The heads 110 of the golf clubs 100 exposed outside the insertion tubes 9 are disposed in the center position of the frame 5 by the head partition members 57 and 58 as shown in FIG. 11, and guided and supported by means of the head partition members 57 and 58 of the separation means 25, thus achieving the following advantages:

(a) the golf club heads do not clash with each other; and (b) the identification number of each head 110 of the golf clubs 100 supported in each head partition member 57 and 58 may be easily discerned from the outside.

Figure 13:
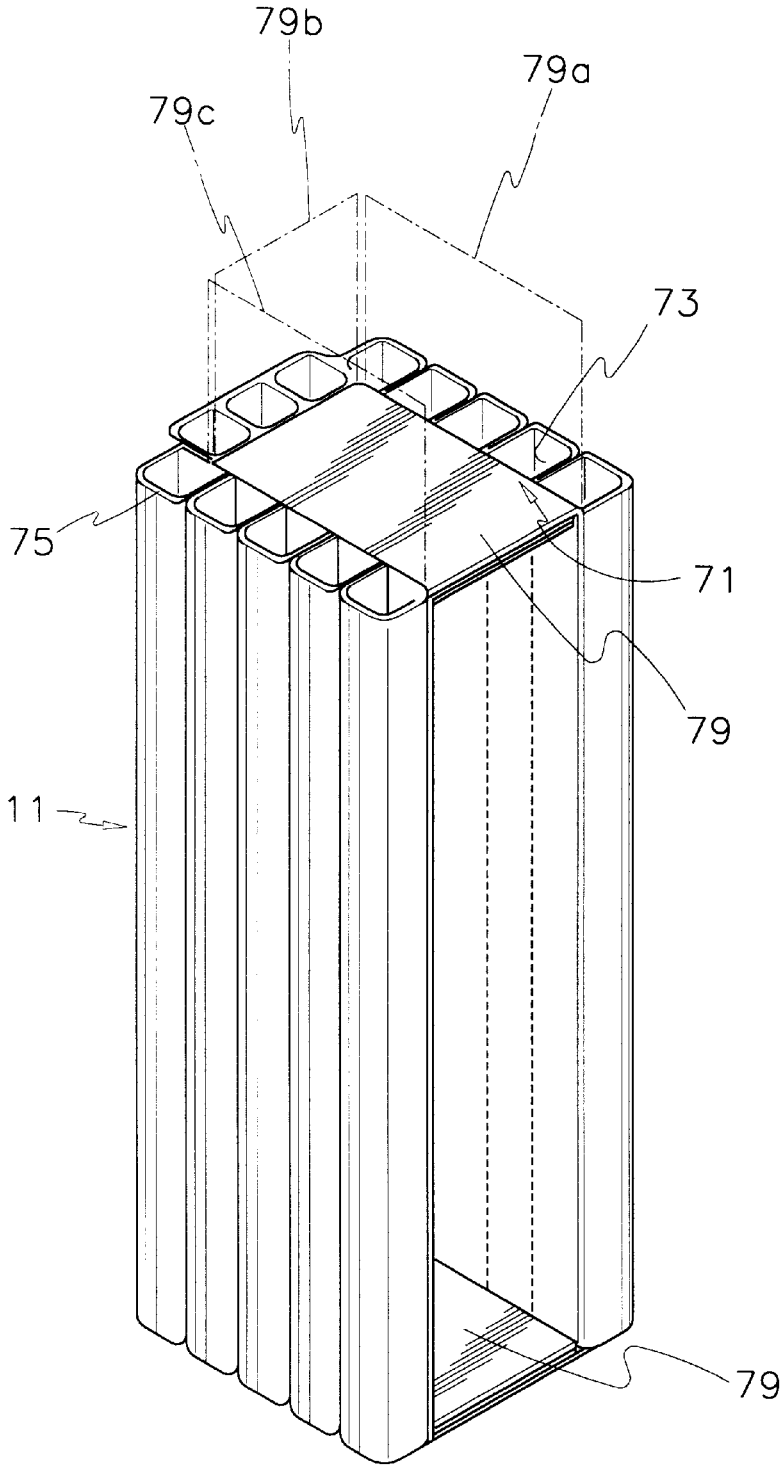
FIG. 13 is a partial perspective view of the golf bag according to the fourth embodiment of the present invention.
Figure 14:
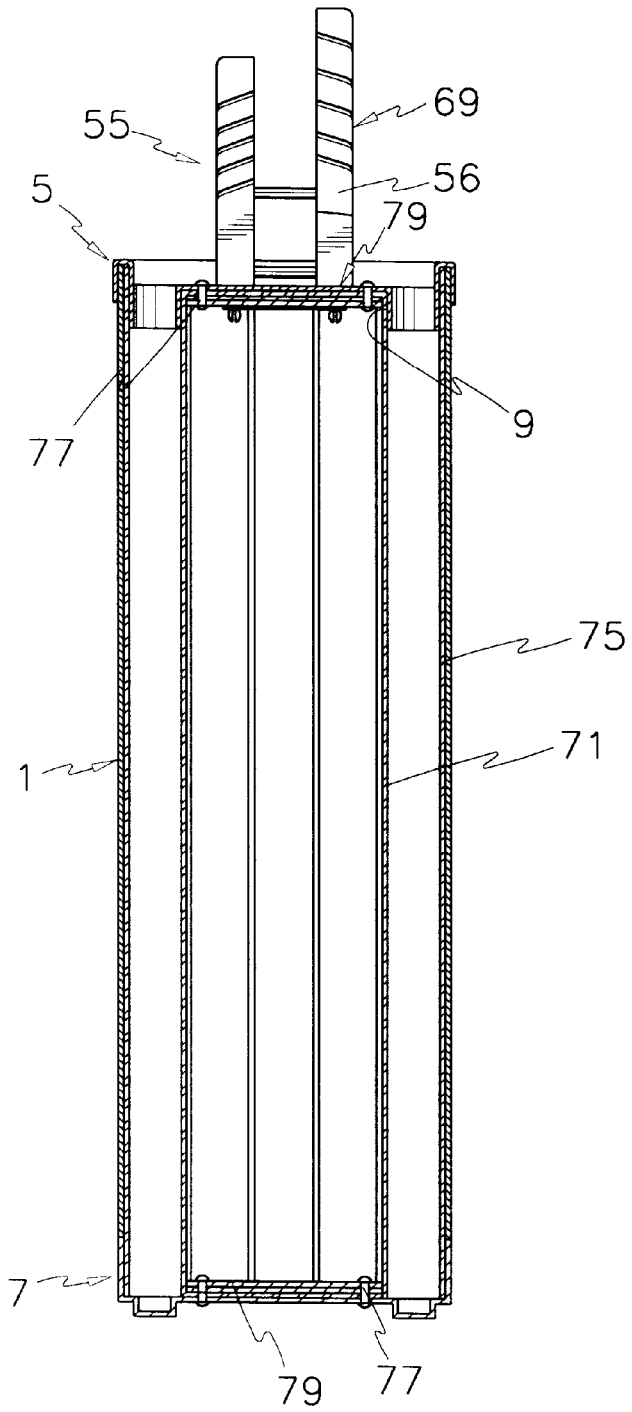
FIG. 14 is a cross sectional view illustrating the assembly of the golf bag according to the fourth embodiment of the present invention.

FIGS. 13 and 14 show the golf bag according to a fourth embodiment of the present invention, the fourth embodiment has the same technical features as the third embodiment of the present invention other than the hereinafter mentioned description.

The above tube set 11 comprises a frame support member 71 formed with a soft material having an arbitrary size and flexibility, such as cloth or leather, and a soft support member 75 coupled with the frame support member 71 at an arbitrary interval by sewing or a coupling means so that an insertion hole 73 is formed for the insertion of the golf club 100.

The frame support member 71 and soft support member 75 are coupled to the frame 5 and the lower body 7 while the same is supported in a tightly stretched state so that the insertion hole 73 can be maintained in an arbitrary pattern, including a polygon or a circle, to insert a golf club.

The frame support member 71 is preferably disposed along the tube set 11, that is, into one open face of the overall tube set 11 configuration (i.e., the "" shape) that the insertion tubes 9 form in the frame 5.

The both sides of the frame support member 71 are also provided with an extended support member 79, wherein making an extended formation with an arbitrary size along the faces having the configuration of the tube set 11, so that the same couples by riveting the frame support member 71 and soft support member 75 with the frame 5 and the lower body 7, respectively.

The extended support member 79 is preferably formed with a hard material such as synthetic resin for making a form of the frame support member 71 and the soft support member 75, and for being tightly assembled with the frame 5 and the lower body 7.

The extended support member 79 is preferably coupled to both the frame 5 and the lower body 7 while each face 79*a*, 79*b*, and 79*c* having the configuration of the tube set 11 are uniformly folded with one another.

Figure 15:
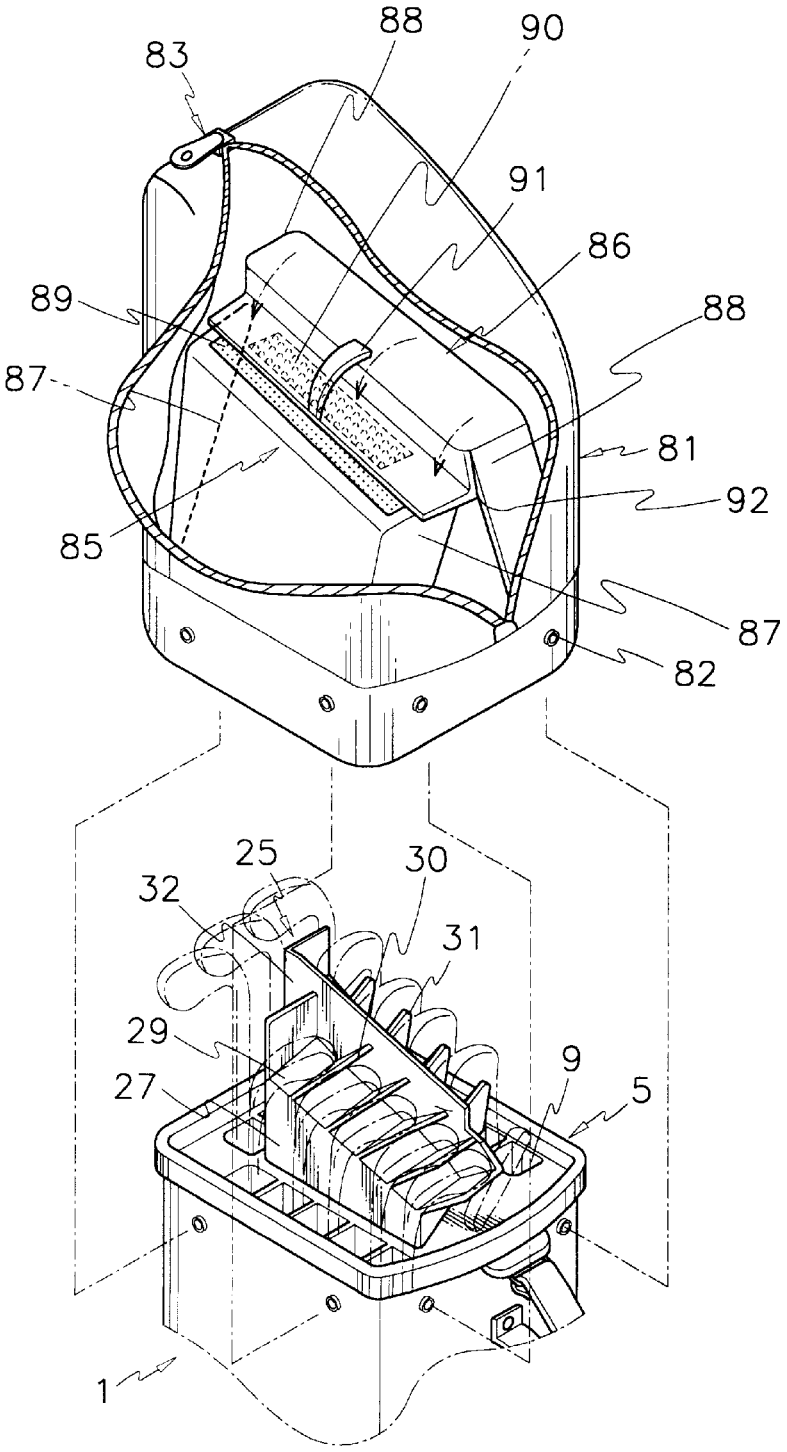
FIG. 15 is a perspective view of a golf bag according to the fifth embodiment of the present invention.
Figure 16:
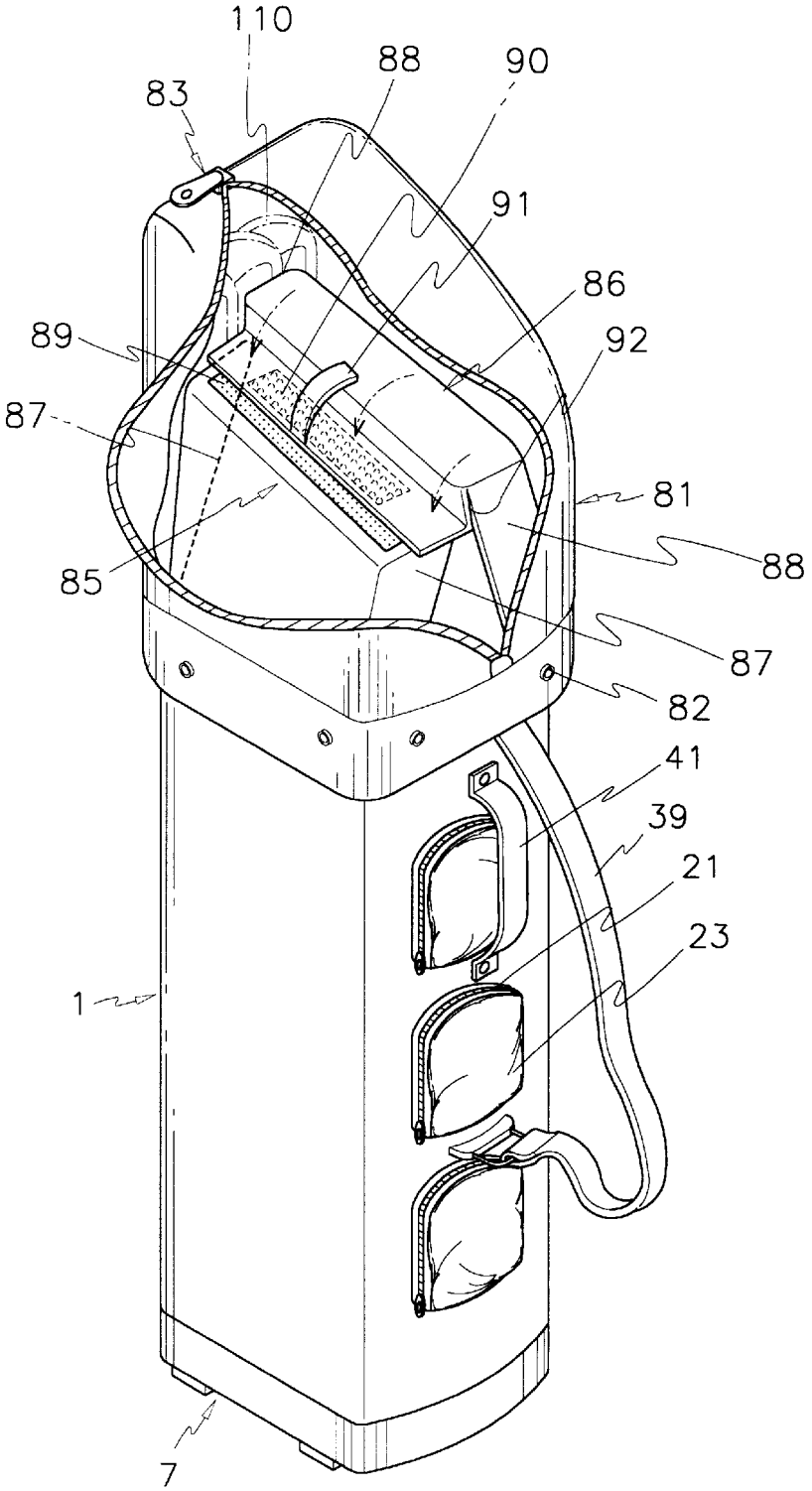
FIG. 16 is a perspective view illustrating the usage of the golf bag according to the fifth embodiment of the present invention.

FIGS. 15 and 16 show the golf bag according to a fifth embodiment of the present invention. The fifth embodiment has the same technical features as the first embodiment of the present invention other than the hereinafter mentioned description.

At the upper portion of the upper body 1, a cover 81 for covering the head 110 of the golf clubs 100 exposed to the upper portion of the frame is coupled with a coupling element 82 for possible detachment and is also opened or closed by a zipper 83.

At both inner side faces of the cover 81 are formed first and second inner covers 85 and 86 for each row of the upper portion of the head partition members 30 and 31 so that the golf clubs can be prevented for movement while covering the heads 110 of each row of the golf clubs 100 that are separated by each row of the head partition member.

Third and fourth inner covers 87 and 88 are extended to both side faces of first and second inner covers 85 and 86 for completely covering the front and back sides of the head partition members 30 and 31 in order to fix tightly the head of the golf clubs when covering the heads 110 of the golf clubs 100 by the first and second inner covers 85 and 86.

The first and second inner covers 85 and 86 are formed with different heights corresponding to each row of the head partition members 30 and 31 by the third and fourth inner covers 87 and 88 such that the second inner cover 86 is preferably formed longer than the first inner cover 85 for covering the upper portion of the first inner cover 85.

At an edge face of the first and second inner covers 85 and 86 are coupled a button, a zipper, and velcro fasteners 89 and 90 for fixing the first and second inner covers 85 and 86.

At the outer face of the second inner cover 86 is coupled a strap 91 in order to facilitate the coupling or detachment of the first inner cover 85.

At the fourth inner cover 88 is formed a cutting portion 92 of an arbitrary length in order to facilitate the covering and detachment of the head 110 of the golf club 100 with the fourth inner cover 88.

Before the upper portion of the upper body 1 is covered with the cover 81, each row of the head partition members 30 and 31 is consecutively covered with the first and second inner covers 85 and 86 and the heads 110 of each row of the golf clubs 100 that are separated by each row of the head partition members 30 and 31 are then completely covered with the first, second, third, and fourth inner covers 85, 86, 87, and 88.

The first and second inner covers 85 and 86 can be coupled using the velcro fasteners 89 and 90 while holding the strap 91, and the zipper 83 can then be closed.

Figure 17:
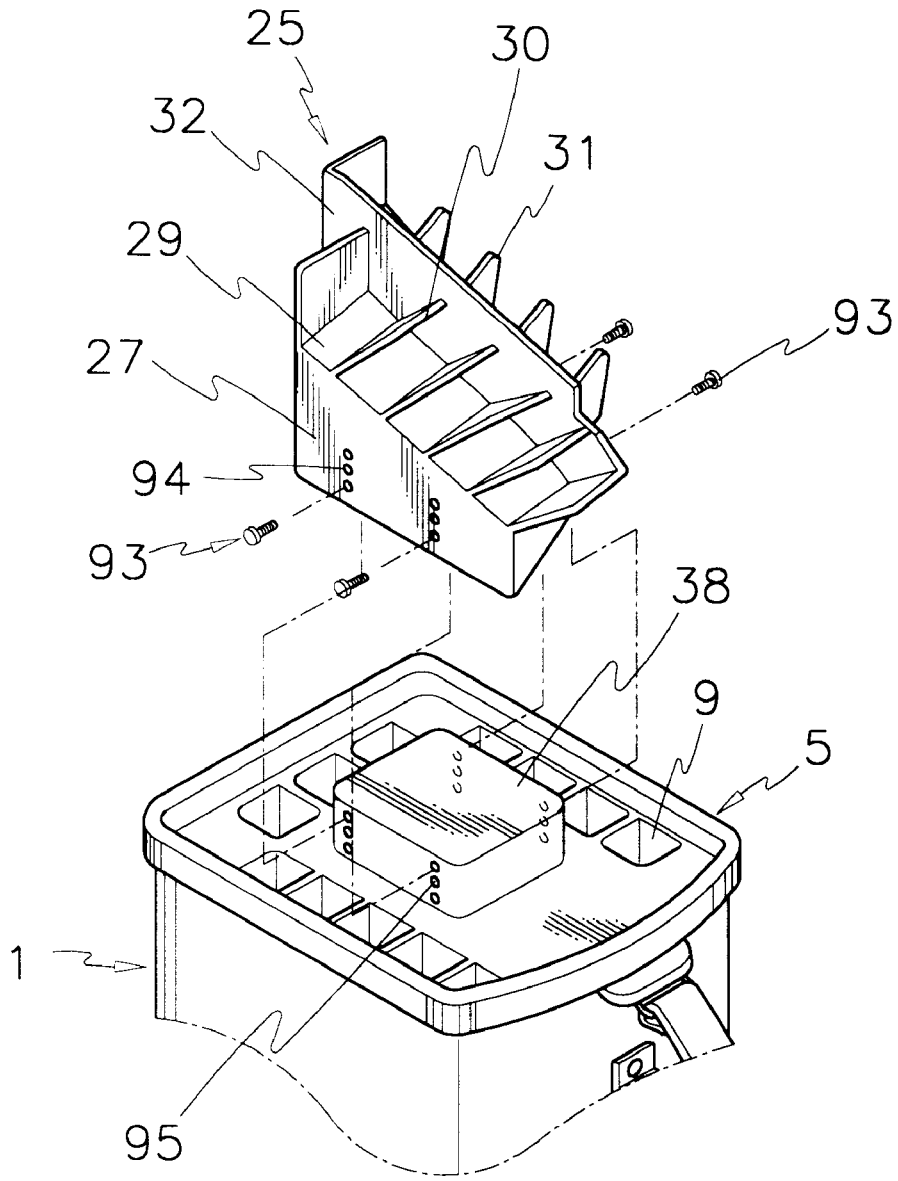
FIG. 17 is a partial exploded perspective view of the golf bag according to the sixth embodiment of the present invention.
Figure 18:
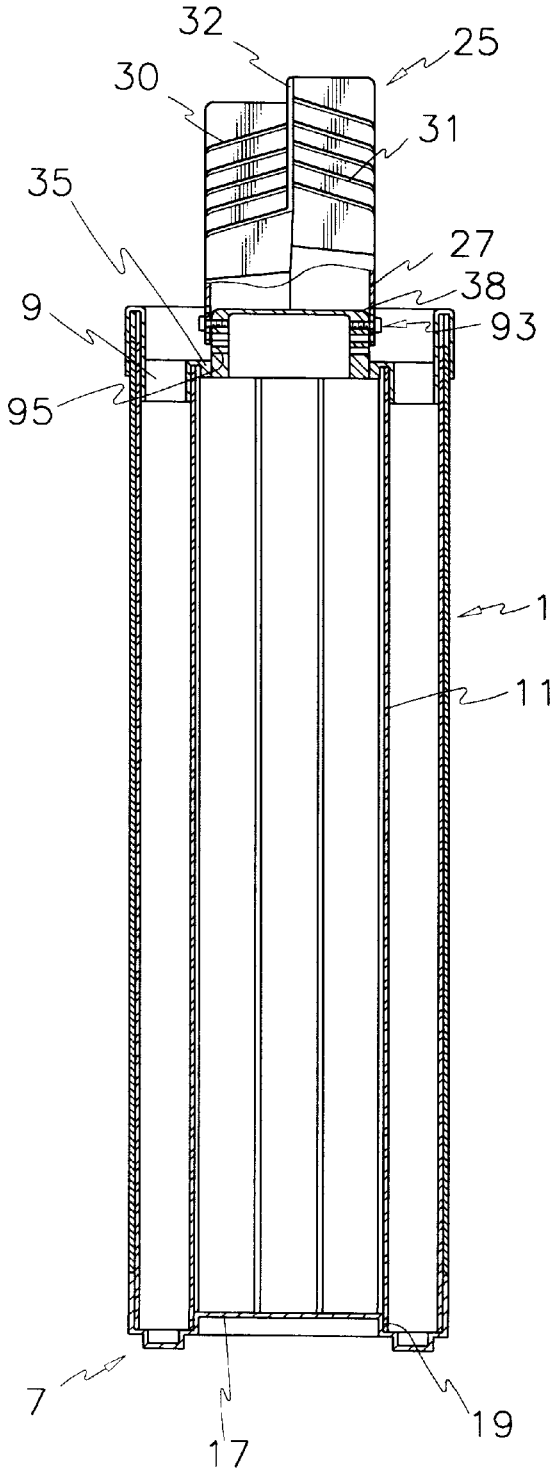
FIG. 18 is a partial cross sectional view illustrating the assembly of FIG. 16.
Figure 19:
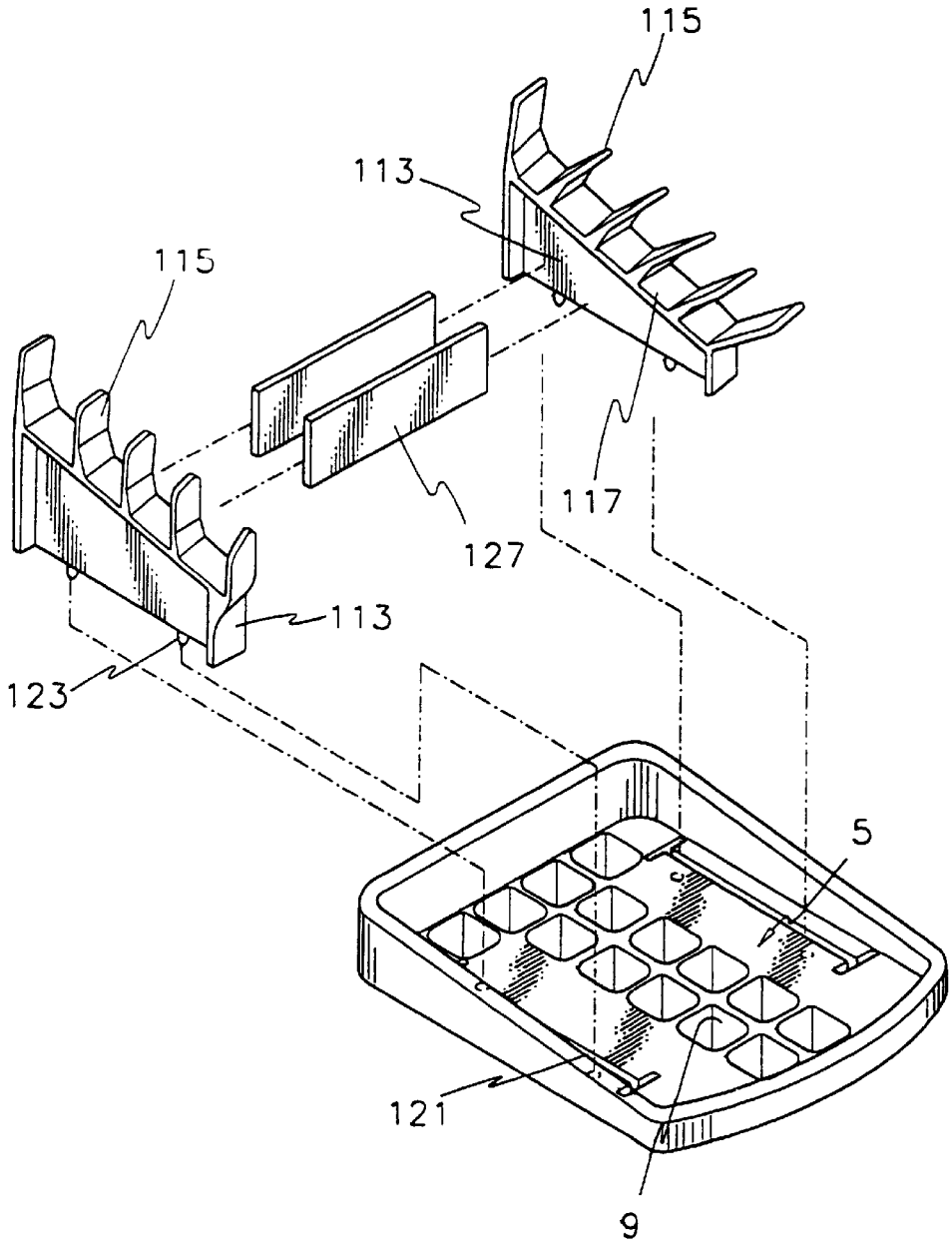
FIG. 19 is an exploded perspective view of main parts of the golf bag according to the seventh embodiment of the present invention.
Figure 20:
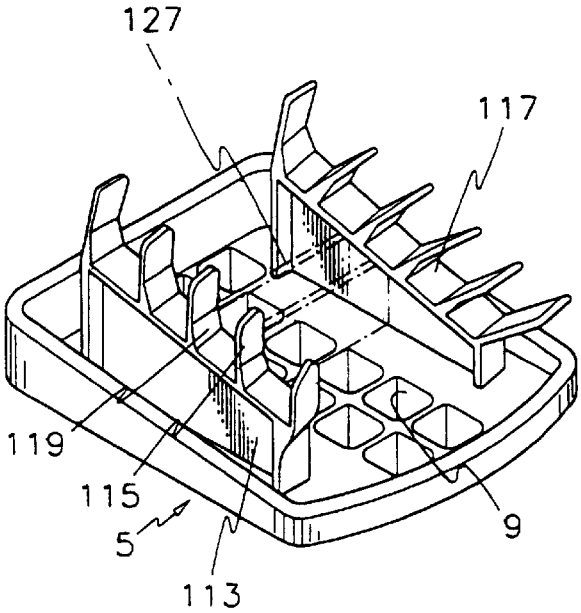
FIG. 20 is a perspective view illustrating the assembly of FIG. 18.
Figure 21:
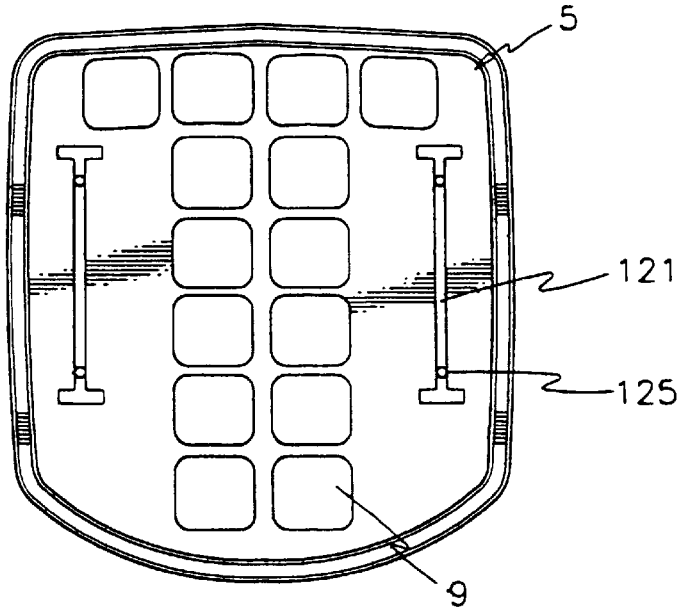
FIG. 21 is a plane view illustrating the frame of a golf bag according to the seventh embodiment of the present invention.
Figure 22:
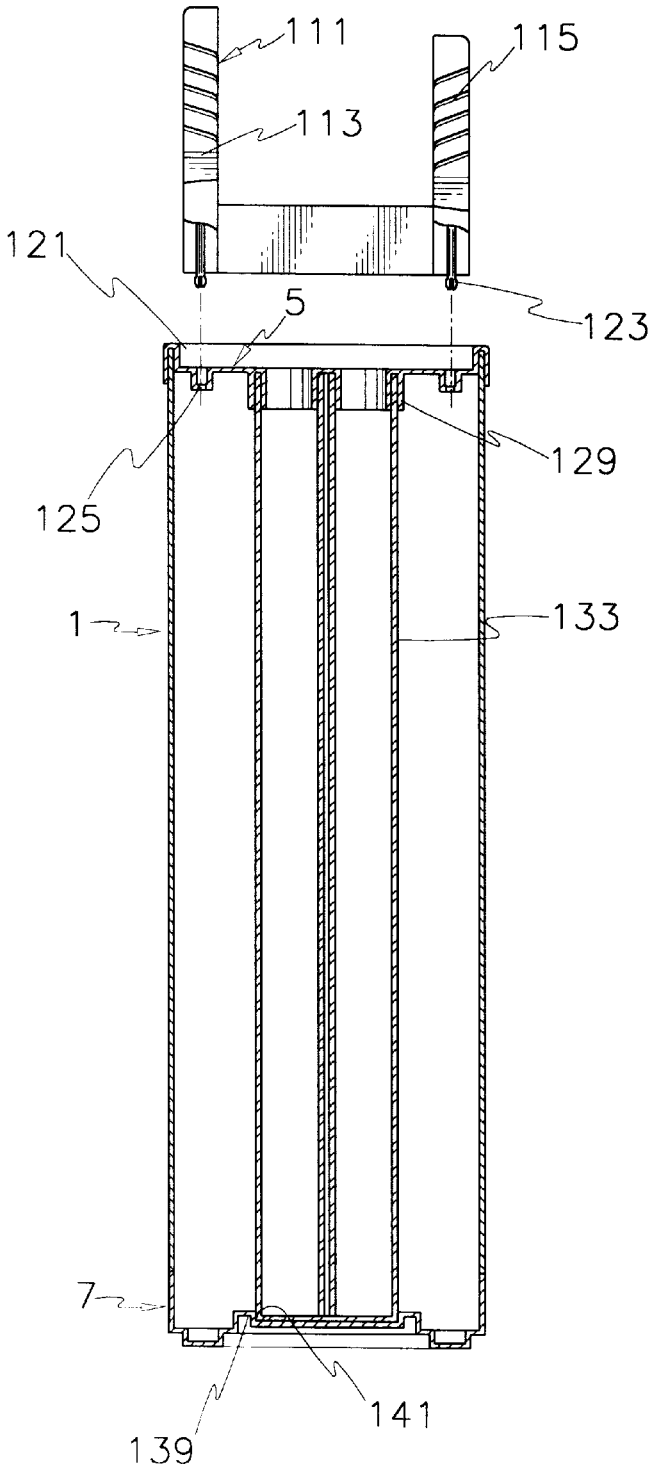
FIG. 22 is a partial exploded cross sectional view illustrating the assembly of the golf bag according to the seventh embodiment of the present invention.
Figure 23:
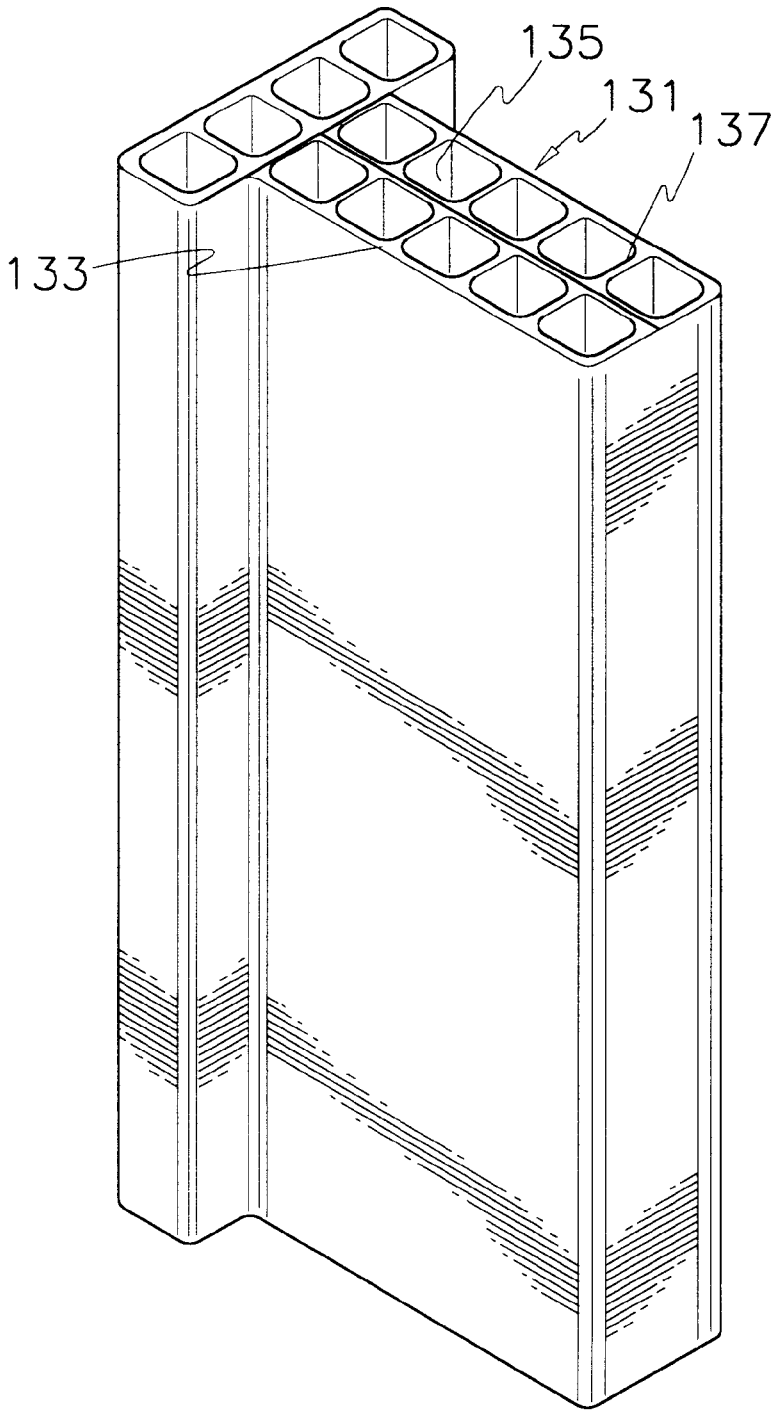
FIG. 23 is a perspective view of the tube set according to the seventh embodiment of the present invention.

FIGS. 17 and 18 show the golf bag according to a sixth embodiment of the present invention. The sixth embodiment has the same technical features as the first embodiment of the present invention other than the hereinafter mentioned description. The hereinafter mentioned description is also applicable to first or third embodiment of the present invention.

At the base 27 is disposed a height controlling unit 38 for controlling the height of the base 27 vertically from the upper face of the frame 5 so that the upper face of the base 27 and the head 110 of each golf club 100 can be maintained with an arbitrary interval according to the length of a golf club 100 that is different from that of the standard golf clubs 100.

The height controlling unit that is formed with more than one row spaced at an arbitrary interval on both side faces of the base 27 consists of a coupling hole 94 for coupling a controlling bolt 93 and a screw hole 95 that is formed on both side faces of the protrusion portion 38 of the frame 5 for fixing the controlling bolt 93 with the coupling hole 94.

The base 27 controls the height according to the length of the golf club 100 from the upper face of the frame 5 to a position having an arbitrary interval between the head 110 of the golf club 100 and the upper face of the base 27.

The control of the height of the base 27 can be maintained by matching each corresponding screw hole 95 with each coupling hole 94 that is positioned at an arbitrary height from the upper face of the frame 5 among the coupling holes 94 and then by inserting each controlling bolt 93 through the coupling hole 94 and screw hole 95.

FIGS. 19 through 26 show the golf bag according to a seventh embodiment of the present invention. The seventh embodiment has the same technical features as the first embodiment of the present invention other than the hereinafter mentioned description. These features are also applicable to the height controlling unit of the sixth embodiment of the present invention.

At the center portion of the frame 5 are formed an insertion portion 9 with more than one row, wherein the same is situated at an arbitrary interval from both sides of the frame 5 and allows for a golf club 100 to be inserted inside an upper body. An overall array pattern of the insertion portion 9 is made in a T-type pattern.

The frame 5 is coupled with a separation means, wherein the separation means 111 is provided for the easy discernment of the head 110 of each golf club 100 that is inserted inside an upper body through the insertion portion and separates the golf clubs 100 while supporting the side face of the head 110 of the golf club 100 in order to prevent clashes between the head 110 of the golf club 100 and the frame 5.

The separation means comprises the insertion portion 9, a plurality of base members 113 disposed at a space between side faces of the frame 5, and a head partition members 115, wherein at the upper face of the base member 113 are disposed a plurality of head partition members 115 with more than one row, wherein a head 110 of each golf club 100 that is inserted inside the upper body 1 through the insertion portion 9 can be separated, situated toward the outside area of the frame 5, guided, and supported so that it does not strike another head 110 of another golf club 100.

The upper part of the base member 113 is formed with a slanted portion 117 with an arbitrary angle or with a horizontal portion (not shown) of a step pattern so that a golf club 100 separated by the head partition member 115 can be easily discerned from the outside and the side face of the head 110 of the golf club 100 can be supported.

The heights of each row of the base members 113 are either made according to a slope progressing from one side face to the other side face, or vary (or do not vary) according to the length of the golf clubs 100 so that each head 110 of a golf club 100 is precisely supported by the head partition members 15 in order to prevent clashes between club heads and to make it easy to discern each identification number inscribed on the heads 110 of the golf clubs 100.

The head partition member 115 can be formed at a right or some other predetermined angle with the upper face and the side face of the base member 113 to allow for an easy discernment of the separated golf clubs according to the type of golf club.

The above head partition member 115 is preferably made of a soft material so that it causes no damage to the heads 110 of the golf clubs 100 and minimizes contact noise.

On one side of the head partition member 115 is disposed a reinforcement partition 119, whereon the same is extended to an arbitrary size so that the same stably supports the head 110 of the golf club 100 inserted into the head partition member and strengthens the rigidity of the head partition member.

In a lower face of the base member being made in an I-type shape is formed a hook hole 125 to hook a hook protrusion 123 of the base members 113, wherein the frame 5, that is also made with an I-type shaped coupling home 121 for coupling with the base members 113, fixedly couples the base members 113 in the coupling home 121 of the frame 5.

The coupling home 121 is made in an I-type shape being the same shape as the bottom portion of the frame 5. However, any shape is can be used as far as it can be connected with the frame 5 and the frame 5. The base member 113 can also be coupled by bolting.

Between the base member 113 is provided more than one reinforcement member 127 to strengthen the rigidity of the base member 113.

A bottom portion of the frame 5 is provided with a protrusively disposed connecting tube 129 of an arbitrary size for inserting a golf club 100 that is inserted through the insertion portion 9.

The connecting tube 129 is coupled with a tube set 131 for separating each golf club 100 situated inside the upper body 1 through the connecting tube 129 and for respectively supporting the heads 110 of each golf club 100 to the head partition members 115.

The connecting tubes 129 are disposed along the center portion of the frame 5 at arbitrary intervals so that the head 110 of a golf club 100 which is inserted into the golf bag is positioned outside the frame 5, and wherein the connecting tube 129 is preferably made in any shape such as a rectangle or a circle, so far as a golf club can be inserted therein.

The above tube set 131 comprises a body 133 that is formed of an arbitrary size and shape at the bottom portion of the frame 5, and a partition portion 137 coupled with the connecting tube 129 by insertion, with insertion holes 135 made for the insertion of the golf clubs 100.

The above body 133 is formed as a unit with a rigid material such as synthetic resin or metal having an ability to retain its shape, wherein both sides of the body 133 are directly coupled by the insertion of insertion holes 135 in the connecting tube 129 and lower body 7.

The bottom portion of the body 133 is coupled as a unit with a coupling home 141 that is made by a hook protrusion 139 protrusively formed in the center portion of the lower body 7.

The above body 133 is preferably made in a three dimensional rectangular shape with a minimum amount of predetermined structural strength, while the same is preferably made in the same configuration as the overall array configuration (for example, "T" shape) of the insertion portions 9 formed in the frame 5.

The above body 133 can also be made of a plurality of member units that are formed corresponding to the direction of the installation of the insertion holes 135 and respectively formed at arbitrary intervals.

According to the golf bag of the seventh embodiment of present invention, the upper portion of the body 133 of the tube set 131 is coupled with the connecting tube 129 of the frame 5 as a unit by insertion, while the upper body 1 is coupled with the frame 5 and the lower body 7. The bottom portion of the body 133 is also coupled as a unit by insertion with the coupling home 141 that is formed at the lower body 7.

The base member 113 is coupled with the frame 5 such that the bottom of the base member 113 of the separation means is inserted by the coupling home 121 that is formed between both sides of the insertion portion 9 and the frame 5, and thus hooks the hook protrusion of the base member 113 to the hook hole 125.

With the above mentioned structure, when the golf clubs 100 are respectively inserted into each insertion portion 9 corresponding to each head partition member 115 of the separation means according to the size of golf club, the golf clubs 100 are inserted into an insertion hole 135 of the tube set 131 through the connecting tube 129 to thus be separately supported.

Figure 24:
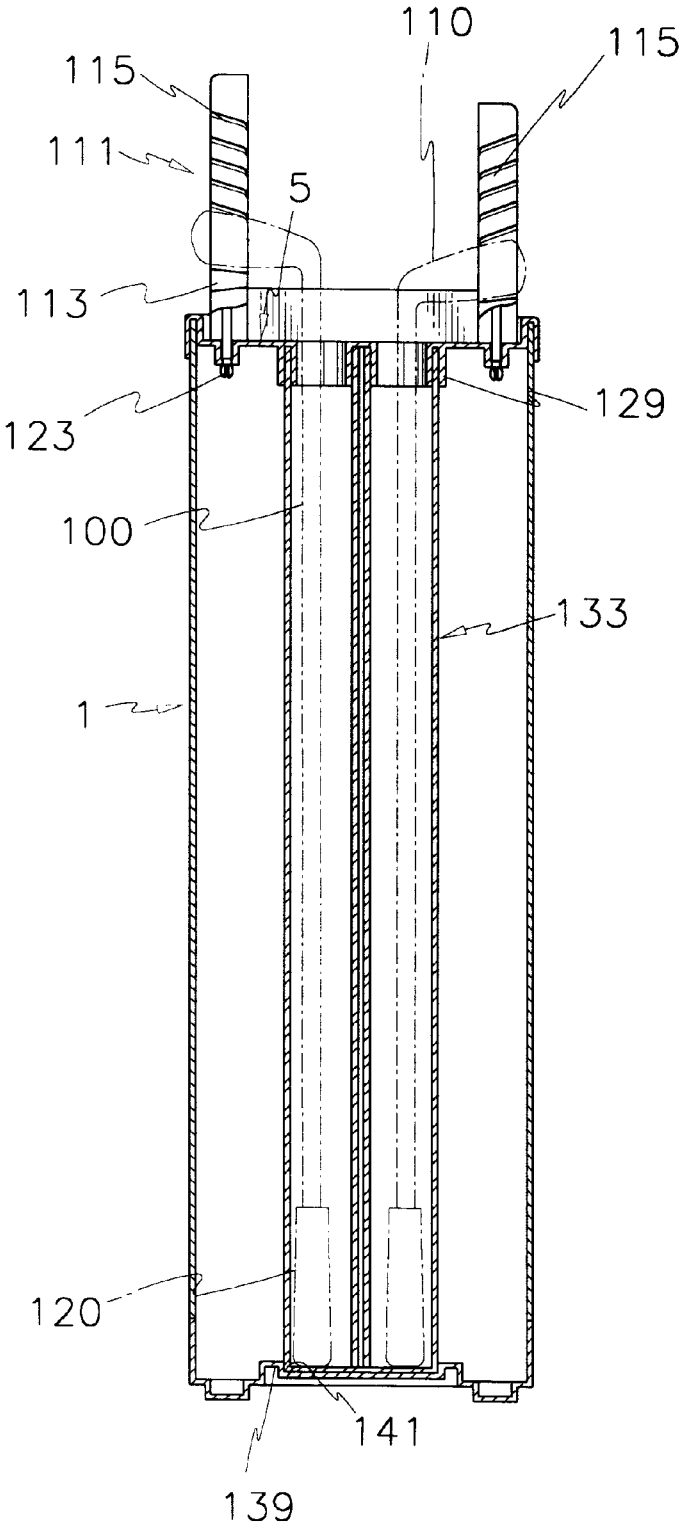
FIG. 24 is a cross sectional view illustrating the usage of the golf bag according to the seventh embodiment of the present invention.

The head of a golf club 100 that is exposed outside the insertion portion 9 is situated outside the frame 5 as shown in FIG. 24, wherein the same is stably supported by the head partition member 115 of the separation means corresponding to the insertion tube 9 without clashing with a head 110 of another golf club 100 and the slanted portion 117 or the horizontal portion of step type. The heads 110 of golf clubs 100 are visible as they are held by each head partition member 115 so that each identification number inscribed on the heads 110 of the golf clubs 100 can be easily discerned from the outside.

Figure 25:
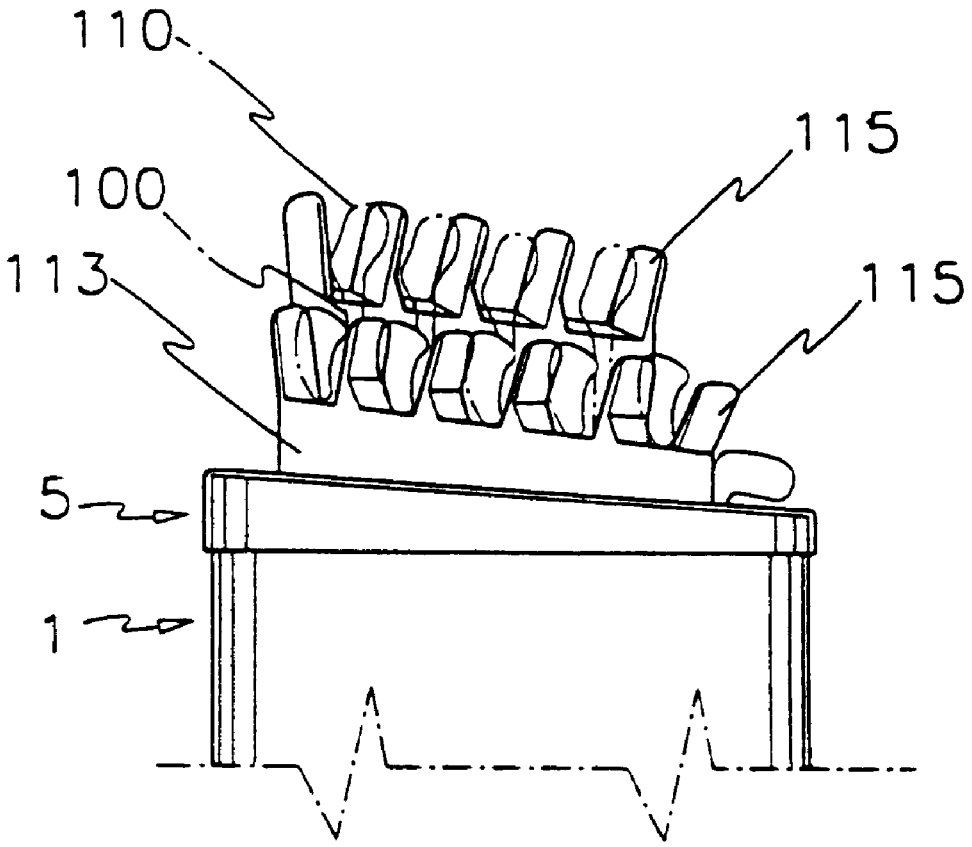
FIG. 25 is a partial side view illustrating the usage of the golf bag according to the seventh embodiment of the present invention.

The head 110 of the golf club 100 used for putting that is inserted in an insertion tube 9 positioned at the forefront lower portion of the base 113 is supported in an arbitrarily sized space that is formed between the front bottom portion of the upper face of the base 113 and the top face of the frame 5 as shown in FIG. 25.

A grip of each golf club 100 is also supported by being completely in contact with a coupling home 141 of the lower body 7 as shown in FIG. 24 while the heads 110 of the golf clubs 100 are separated by a partition supporting member 115 and are also supported by contacting the side face of the partition supporting member 115.

The heads 110 of the golf clubs 100 have an arbitrary interval with the upper face of the base 113 so that the heads 110 of the golf clubs 100 contact the side faces of the partition supporting member 115 and the golf clubs 100 can be supported by the lower body 7.

Since the grip of a golf club 100 is supported and is in contact with the lower body 7, the length of the upper body 1 can be formed with the same height of the upper body of a conventional golf bag.

Figure 26:
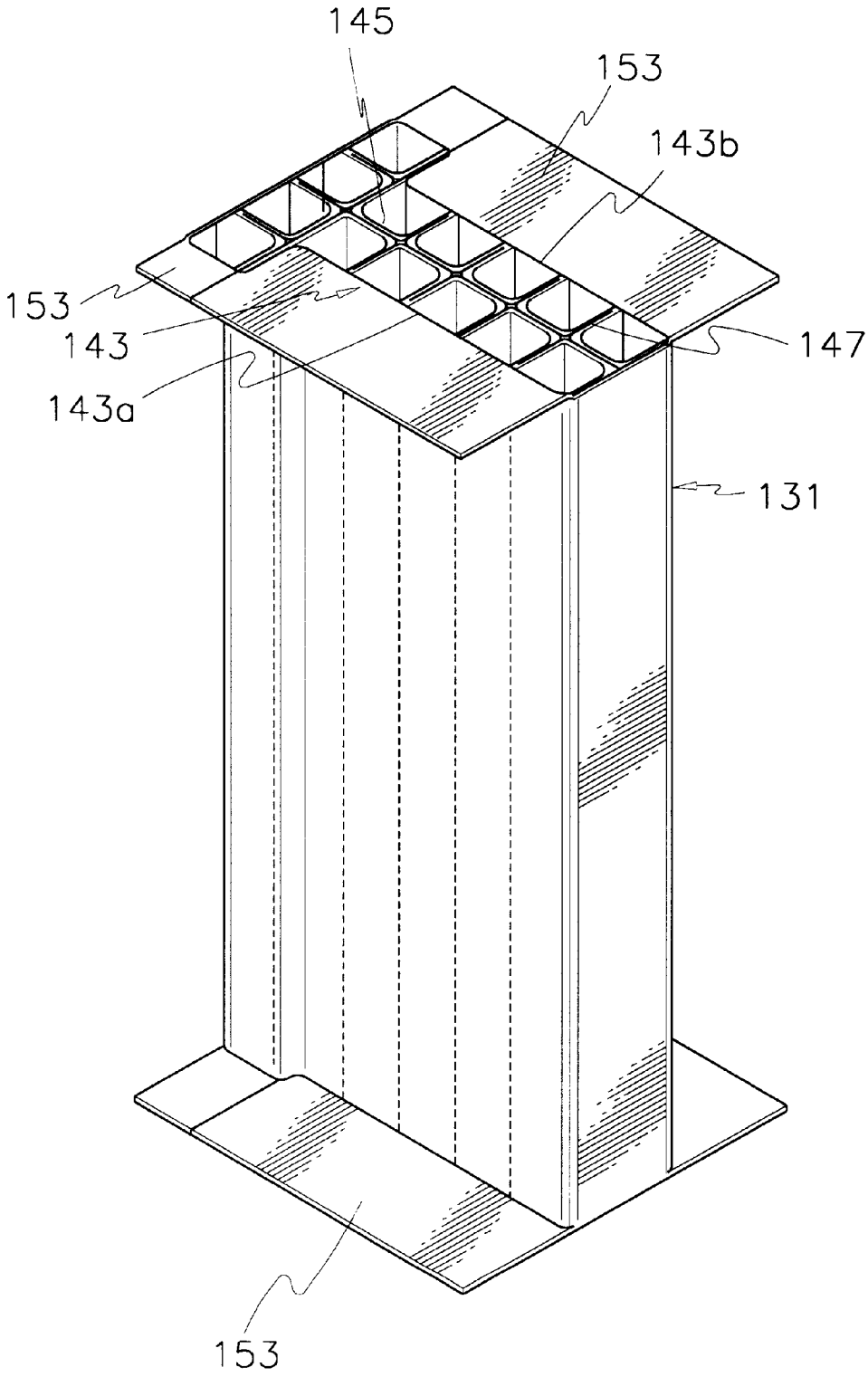
FIG. 26 is a perspective view illustrating the tube set of the golf bag according to the eighth embodiment of the present invention.
Figure 27:
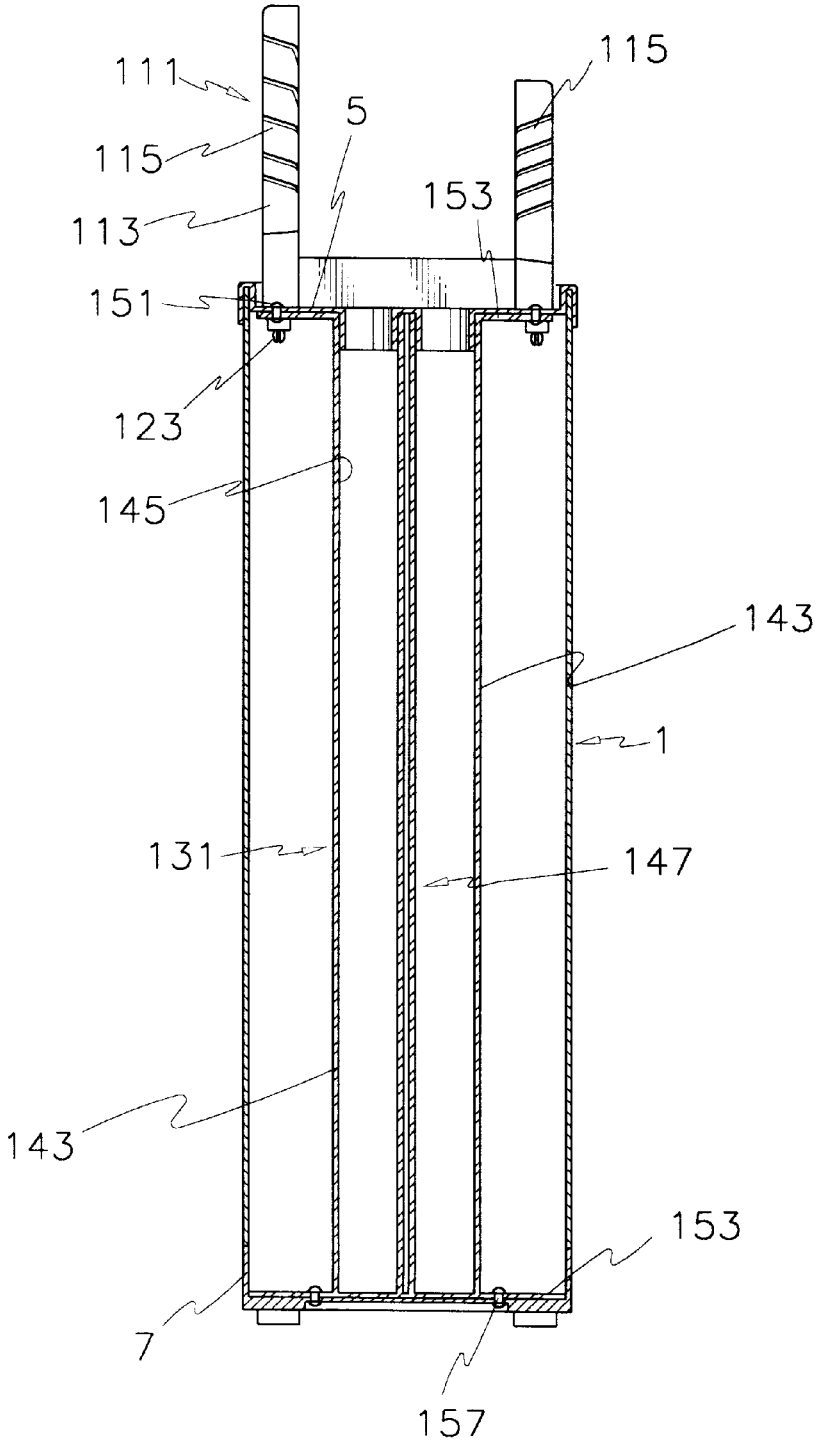
FIG. 27 is a cross sectional view of the golf bag according to the eighth embodiment of the present invention.

FIGS. 26 and 27 show the golf bag according to an eighth embodiment of the present invention. The eighth embodiment has the same technical features as the seventh embodiment of the present invention other than the hereinafter mentioned description.

In this embodiment, the above tube set 131 comprises a frame support member 143 formed with a soft material having arbitrary size and flexibility, such as cloth or leather, and a soft support member 147 coupled with the frame support member 143 along an arbitrary interval by sewing or a coupling means so that insertion holes 145 are formed for the insertion of the golf clubs 100.

The frame support member 143 and soft support member 147 are coupled to the frame 5 and the lower body 7 while the same is supported in a tightly stretched state so that the insertion holes 145 can be maintained in an arbitrary pattern, including that of a polygon or a circle, to allow for the insertion of the golf clubs.

The frame support member 143 is preferably disposed along the tube set 131, that is, along the one face of the overall tube set 131 configuration (i.e., the "T" shape) that the insertion tubes 9 formed in the frame 5.

The both sides of the frame support member 143 are also provided with an extended support member 153, wherein making an extended formation with an arbitrary size along the faces 143*a* and 143*b* having the configuration of the tube set 131, so that the same couples by a rivet 151 that couples the frame support member 143 and soft support member 147 with the frame 5 and the lower body 7, respectively.

The extended support member 153 is preferably formed with a hard material such as synthetic resin for making a form of the frame support member 143 and the soft support member 147 and for being tightly assembled with the frame 5 and the lower body 7.

Figure 28:
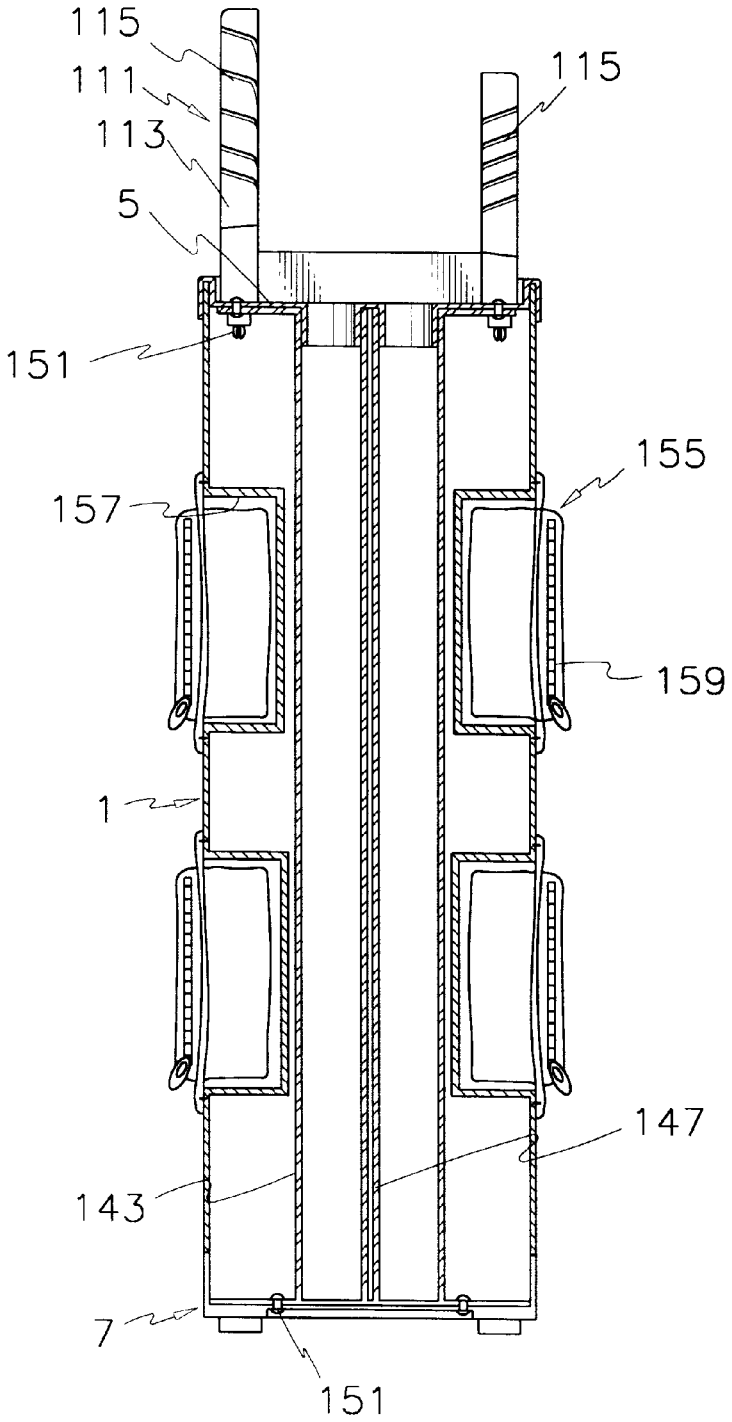
FIG. 28 is a cross sectional view of the golf bag according to the ninth embodiment of the present invention.

FIG. 28 shows the golf bag according to a ninth embodiment of the present invention. The ninth embodiment has the same technical features as the eighth embodiment of the present invention other than the hereinafter mentioned description.

At both sides of the upper body 1 are provided more than one cavity 157 with an arbitrary volume, for inserting a pocket 155 so that a space formed between the upper body 1 and the tube set 131 can be effectively utilized.

The above pockets 155 disposed inside the upper body 1 are opened or closed with a zipper 159 providing access to the cavity 157. The pocket 55 is also coupled with the upper body 1 by sewing.

The pockets 155 are either completely inserted inside the upper body 1 for minimizing the volume protrusively formed outside the upper body 1, or partly inserted thereinto.

The present invention, with a tube set whereby a plurality of golf clubs are divided and inserted, are assembled as a unit, and also has the following merits:

(a) assembly is conveniently accomplished and the tube set has its own predetermined structural strength, so that there is no need for extra reinforced support members;

(b) the golf clubs are supported within the outside surface of the golf bag that the same may be free from damage at the time the golf bag is carried about;

(c) pockets are designed to be placed inside the golf bag such that the volume of the golf bag can become compact and the inside of the golf bag may be effectively utilized with such pockets;

(d) the golf clubs secured in this golf bag that is made without head covers for the golf clubs have no problems with clashing with each other, and even when the golf bag is carried about, the golf clubs are stably settled in the insertion tubes and thus make no clashing noise and no damage of the heads of the golf clubs results;

(e) golf clubs that are properly inserted in the golf bag while golfing or on the driving range can be identified in the shortest time possible and at the same time any lost or missing golf clubs can be easily recognized; and (f) since the soft tube set, wherein a plurality of golf clubs are respectively inserted, is easily coupled as a unit with the frame, the golf bag has simplified assembly features and is quite lightweight.

Other embodiments of the invention will be apparent to the skilled in the art from consideration of the specification and practice of the invention disclosed herein. It is intended that the specification and examples be considered as exemplary only, with the true scope and spirit of the invention being indicated by the following claims.

What is claimed is:

1. A golf club comprising:

an upper body formed in a cylindrical structure;

a frame disposed in the top portion of the upper body for maintaining the configuration of the golf bag;

a lower body installed in the bottom portion of the upper body used as a bottom part enclosing the bottom portion of the upper body for supporting a grip portion of the golf club;

a separation means coupled with the frame and supporting the side face of the head of the golf club wherein the grip portion is supported at the lower body for separating the golf clubs in order to prevent clashes between the head of the golf club and frame and to enable discernment of the head of the golf club that is inserted inside the upper body, wherein the separation means comprises a base disposed in the center portion of the frame; and head partition members installed with more than one row on one face for the base for separating the heads of the golf clubs inserted in the golf bag and for fixing them in place by guiding and supporting the heads of the golf clubs.

2. A golf bag according to claim 1, wherein a tube set is coupled as a unit with the frame for separating and inserting the golf clubs that are inserted through an insertion tube inside the upper body.

3. A golf bag according to claim 1, wherein the base is made as a unit with the frame.

4. A golf bag according to claim 1, wherein an upper face of the base is formed in a slanted portion with an arbitrary angle that the golf clubs divided by the head partition member may be easily discerned and supported at the lower body.

5. A golf bag according to claim 1, wherein the height of each row of the head partition members is made the same corresponding to the length of the golf clubs to make an easy discernment of each identification number inscribed on the heads of the golf clubs according to the length of the golf clubs.

6. A golf bag according to claim 5, wherein the above head partition members are formed at an arbitrary angle with respect to a slanted portion so that the heads of the golf clubs are precisely guided and supported and convincingly settled.

7. A golf bag according to claim 1, wherein the base is made detachable by means of an extra coupling means to facilitate a coupling of the upper body to the frame.

8. A golf bag according to claim 1, wherein the height of each row of the head partition members is made differently corresponding to the length of the golf clubs to enable discernment of each identification number inscribed on the heads of the golf clubs according to the length of the golf clubs.

9. A golf bag comprising:

an upper body formed in a cylindrical structure;

a frame disposed in the top portion of the upper body for maintaining the configuration of the golf bag;

a lower body installed in the bottom portion of the upper body used as a bottom part enclosing the bottom portion of the upper body for supporting a grip portion of the golf club;

a separation means coupled with the frame and supporting the side face of the head of the golf club wherein the grip portion is supported at the lower body for separating the golf clubs in order to prevent clashes between the head of the golf club and frame and to enable discernment of the head of the golf club that is inserted inside the upper body;

wherein a tube set is coupled as a unit with the frame for separating and inserting the golf clubs that are inserted through an insertion tube inside the upper body; and wherein the above tube set comprises a frame support member formed with a soft material having an arbitrary size and flexibility and a soft support member coupled with the frame support member at an arbitrary interval so that an insertion hole is formed for an insertion of a golf club.

10. A golf bag according to claim 9, wherein both sides of the frame support member are also provided with an extended support member making a form of the frame support member and soft support member and making an extend formation with an arbitrary size along faces having a configuration of the tube set, so that the extended support member couples the frame support member and soft support member with the frame and lower body, respectively.

11. A golf bag comprising:

an upper body formed in a cylindrical structure;

a frame disposed in the top portion of the upper body for maintaining the configuration of the golf bag;

a lower body installed in the bottom portion of the upper body used as a bottom part enclosing the bottom portion of the upper body for supporting a grip portion of the golf club;

a separation means coupled with the frame and supporting the side face of the head of the golf club wherein the grip portion is supported at the lower body for separating the golf clubs in order to prevent clashes between the head of the golf club and frame and to enable discernment of the head of the golf club that is inserted inside the upper body;

a cover coupled to the upper portion of the upper body for covering the upper portion of the frame; and first and second inner covers formed at both inner side faces of the cover to each row of the upper portion of the head partition members so that the golf clubs can be prevented from movement.

12. A golf bag according to claim 11, wherein at an edge face of the first and second inner covers are coupled by at least one of a button, a zipper, and a hook and loop fastener for fixing the first and second inner covers while covering the first and second inner covers.

13. A golf bag comprising:

an upper body formed in a cylindrical structure;

a frame disposed in the top portion of the upper body for maintaining the configuration of the golf bag;

a lower body installed in the bottom portion of the upper body used as a bottom part enclosing the bottom portion of the upper body for supporting a grip portion of the golf club;

a separation means coupled with the frame and supporting the side face of the head of the golf club wherein the grip portion is supported at the lower body for separating the golf clubs in order to prevent clashes between the head of the golf club and frame and to enable discernment of the head of the golf club that is inserted inside the upper body;

wherein the above separation means comprises a base disposed in the center portion of the frame;

head partition members installed with more than one row on one face of the base for separating the heads of the golf clubs inserted inside the golf bag and for fixing them in place by guiding and supporting the heads of the golf clubs;

a coupling hole being formed with more than one row spaced with an arbitrary interval on both side faces of the base for coupling a controlling bolt in order to control the height of the base from the upper face of the frame; and a screw hole being formed on both sides faces of the protrusion portion of the frame for fixing the controlling bolt with the coupling hole.

14. A golf bag comprising:

an upper body formed in a cylindrical structure;

a frame disposed in the top portion of the upper body for maintaining the configuration of the golf bag;

a lower body installed in the bottom portion of the upper body used as a bottom part enclosing the bottom portion of the upper body for supporting a grip portion of the golf club; and a separation means coupled with the frame and supporting the side face of the head of the golf club wherein the grip portion is supported at the lower body for separating the golf clubs in order to prevent clashes between the head of the golf club and frame and to enable discernment of the head of the golf club that is inserted inside the upper body;

wherein the separation means comprises an insertion portion, a plurality of base members disposed at a space between side faces of the frame, and a head partition members, wherein at the upper face of the base member are disposed a plurality of head partition members with more than one row, wherein a head of the golf club that is inserted inside the upper body through the insertion portion can be separated and situated toward the outside area of the frame and the side face of the head of the golf club is guided and supported so that it does not strike another head of another golf club;

wherein at the bottom portion of the frame is provided a protrusively disposed insertion tube with an arbitrary size for inserting a golf club that is inserted through the insertion portion, and wherein the insertion tube is coupled with a tube set configured as a T-type shape inside of the golf bag, and wherein the insertion tube with a tube set is coupled inside the upper body, and thereby stably supporting the heads of each golf club to head partition members.

15. A golf bag according to claim 14, wherein the tube set comprises a body that is formed with a rigid material in an arbitrary size and shape at the bottom portion of the frame and a partition portion coupled with the insertion tube by insertion wherein an insertion hole is made for the insertion of a golf club.

16. A golf bag according to claim 14, wherein the tube set comprises a frame support member formed with a soft material having an arbitrary size and flexibility and a soft support member coupled with the frame support member along an arbitrary interval as a T-type shaped coupling so that insertion holes are formed for the insertion of the golf clubs.

17. A golf bag according to claim 16, wherein both sides of the frame support member are provided with an extended support member making an extend formation along faces having the configuration of the tube set and respectively coupling the frame support member and soft support member with the frame and the lower body.

18. A golf bag according to claim 14, wherein at more than one face of the upper body is provided one or more pocket at cavities for utilizing space formed between the upper body and the tube set.

* * * * *